US011458753B2

(12) United States Patent
Rowe et al.

(10) Patent No.: US 11,458,753 B2
(45) Date of Patent: Oct. 4, 2022

(54) DOCUMENTS AND METHODS OF MANUFACTURE THEREOF

(71) Applicant: DE LA RUE INTERNATIONAL LIMITED, Basingstoke (GB)

(72) Inventors: Mark Rowe, Basingstoke (GB); Stuart William John Rost, Fleet (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 0 days.

(21) Appl. No.: 17/278,830

(22) PCT Filed: Sep. 26, 2019

(86) PCT No.: PCT/GB2019/052722
§ 371 (c)(1),
(2) Date: Mar. 23, 2021

(87) PCT Pub. No.: WO2020/065327
PCT Pub. Date: Apr. 2, 2020

(65) Prior Publication Data

US 2022/0032669 A1 Feb. 3, 2022

(30) Foreign Application Priority Data

Sep. 27, 2018 (GB) ..... 1815779

(51) Int. Cl.
*B42D 25/351* (2014.01)
*B41M 3/14* (2006.01)
(Continued)

(52) U.S. Cl.
CPC ..... *B41M 3/14* (2013.01); *B42D 25/29* (2014.10); *B42D 25/318* (2014.10); *B42D 25/351* (2014.10); *B42D 25/405* (2014.10)

(58) Field of Classification Search
CPC ..... B42D 25/351; B42D 2035/34; B42D 2035/36
See application file for complete search history.

(56) References Cited

U.S. PATENT DOCUMENTS 4,168,088 A 9/1979 Somlyody
5,855,989 A * 1/1999 Mantegazza ..... B42D 25/29 428/195.1
(Continued)

FOREIGN PATENT DOCUMENTS

CN 1993714 A * 7/2007 ..... B42D 25/41
CN 108074321 A 5/2018
(Continued)

OTHER PUBLICATIONS

Jan. 3, 2020 International Search Report issued in International Patent Application No. PCT/GB2019/052722.
(Continued)

*Primary Examiner* — Kyle R Grabowski
(74) *Attorney, Agent, or Firm* — Oliff PLC

(57) ABSTRACT

A method of manufacturing a document of a series identical documents in content except for a respective identifier which identifies each document within the series, each identifier having at least a first indicium, the or each indicium defining a boundary; the method having the steps of: providing a substrate; applying a first background print, defining part of the boundary of an indicium receiving area; applying the respective identifier on the substrate, such that the first indicium is provided in the indicium receiving area; the first background print and the respective identifier being applied such that when the document is viewed in at least one of transmission and reflection the juxtaposition of the first background print and the first indicium is such that a keyline extending around a portion of the boundary of the first indicium is defined between the first indicium and the boundary of the indicium receiving area.

18 Claims, 16 Drawing Sheets

(51) Int. Cl.

| | |
|---|---|
| ***B42D 25/29*** | (2014.01) |
| ***B42D 25/318*** | (2014.01) |
| ***B42D 25/405*** | (2014.01) |

(56) References Cited

U.S. PATENT DOCUMENTS

| | | | | |
|---|---|---|---|---|
| 6,089,614 | A * | 7/2000 | Howland | B42D 25/351 283/91 |
| 8,774,450 | B2 * | 7/2014 | Fan | G06T 1/0028 382/100 |
| 2009/0160177 | A1 * | 6/2009 | Dietrich | B31D 1/026 283/70 |
| 2009/0315318 | A1 * | 12/2009 | Jones | B42D 25/00 283/85 |
| 2013/0181434 | A1 * | 7/2013 | Prique | B42D 25/24 283/72 |

FOREIGN PATENT DOCUMENTS

| | | | | |
|---|---|---|---|---|
| DE | 102017010060 | A1 * | 6/2018 | B42D 25/378 |
| EP | 0334390 | A2 | 9/1989 | |
| EP | 2803497 | A1 | 11/2014 | |
| GB | 2542783 | A * | 4/2017 | B42D 25/24 |
| GB | 2542784 | A * | 4/2017 | B42D 25/24 |
| WO | 01/87632 | A1 | 11/2001 | |
| WO | 2009/010714 | A1 | 1/2009 | |
| WO | WO-2009062229 | A1 * | 5/2009 | G07D 7/207 |
| WO | WO-2011077403 | A1 * | 6/2011 | B29C 59/02 |
| WO | 2015/129346 | A1 | 9/2015 | |
| WO | 2016/146551 | A1 | 9/2016 | |

OTHER PUBLICATIONS

Mar. 28, 2019 Combined Search and Examination Report issued in Great Britain Patent Application No. 1815779.2.

* cited by examiner

DOCUMENTS AND METHODS OF MANUFACTURE THEREOF

FIELD

Embodiments of the present invention relate generally to documents which are produced and used in large numbers, especially security documents for securing value or proving identity such as banknotes, cheques, passports, identity cards, driver's licences, and the like. Improved manufacturing methods and documents are provided which offer increased security and deter would-be counterfeiters.

BACKGROUND

Historically, documents or products which are manufactured in large numbers may be provided with unique identifiers. Each unique identifier is provided to a single document or product within the larger series.

For instance, security documents (such as banknotes, cheques, passports, identification documents, certificates and licences) are commonly provided with an alphanumeric serial code. These serial codes are applied to the documents sequentially or incrementally so that each document is provided with a unique code which identifies the specific document within the series. Consecutively produced documents differ from each other by a predetermined amount (e.g. by one digit or letter) in a readily recognised series.

These unique identifiers aid in preventing counterfeiting (since any two documents should not bear the same unique identifier) and tracing individual documents (as each document can be individually distinguished using its identifier).

Documents are typically provided with a unique identifier during or after production by means of a numbering machine, sometimes called "numbering boxes", "numbering barrels" or "number printing machines", which is adapted to print a number or code in a desired position or position upon each document and to change, in a predetermined sequence and between documents, the number to be printed by the machine. Numbering (i.e. providing a document with any identifier such as a serial number, serial code or bar code) may also be also be performed by other printing methods.

In contrast other features of a document including background prints, graphics, text and security devices (including holograms, lenticular devices and moiré interference devices) and security prints are often fixed and are not varied between adjacent documents in the series. These fixed features are traditionally printed using gravure, intaglio or lithographic printing which offer cheap and efficient means of printing fixed images. Conventionally the unique identifiers are printed over a fixed background image, or onto a region of the document which is not provided with a background image.

Since much of the document has a fixed appearance, any discrepancies in the appearance or manufacture of the documents (as may exist between genuine and fraudulent documents) may be quickly and easily recognised.

EP 0334390 A2 describes documents and methods for numbering a series of documents with a code formed of a plurality of numerical or alphabetical characters that are arranged above and below one another and wherein the characters vary in physical characteristics such as height, width or type style.

Any person who attempts the unauthorized reproduction of a document with a serial code (or another identifier) is faced with a large number of problems, one of which is that each document in a given series of genuine documents bears its own unique multi-character code in one or more places thereupon. A counterfeiter may attempt to overcome this problem in a number of ways.

For example, they may regard it as sufficient in some circumstances, to produce a plurality of documents, all of which bear identical multi-character codes. This may be done by the repetitive use of a printing plate made from a photograph which includes the multi-character code of one arbitrarily selected genuine document. However, once it is known that an unauthorised reproduction has been made, it is easier to detect further copies if they all bear the same code or identifier.

Another possible solution involves the manufacture and use of a printing plate for printing some only of the characters of a "genuine" or officially used multi-character code (for example, the first three characters thereof) and the later insertion of the missing character(s), by suitably positioning the authorized and partially numbered document so that it receives desired impressions from a numbering machine or from some other printing means or system.

A still further solution for the would-be counterfeiter involves the printing of parts of the multi-character code using printing plates with fixed characters. By altering the side-lay, i.e. the relative position of the printing means and the document being printed, the part characters upon the plate may be printed so that they occupy different positions or locations within the multi-character code. Thus, by the use of a limited number of plates with fixed "part-characters" in conjunction with different combinations of side-lay adjustment, a relatively large number of different multi-character codes may be obtained with a small number of part-character printing operations. Any missing character or characters again must be filled by numbering machines, for example, as mentioned in the preceding paragraph.

Whatever the method employed, the aim of the producer of the unauthorised document is to make its appearance, including the appearance of the identifying numbers, approximate closely to the appearance of the genuine document.

Consequently, it will be appreciated that there is a constant need to improve the security of documents and the identifiers provided to them. The object of this invention is substantially to increase the difficulties faced by the unauthorised reproducer of such documents.

SUMMARY OF INVENTION

According to an aspect of the invention there is provided a method of manufacturing a document of a series of documents which are identical in content except for a respective identifier which uniquely identifies each document within the series, each identifier comprising at least a first indicium, the or each indicium defining a boundary;

the method comprising the steps of:

providing a substrate;

applying a first background print on the substrate, the first background print defining at least part of the boundary of an indicium receiving area;

applying the respective identifier on the substrate, such that the first indicium is provided in the indicium receiving area;

the first background print and the respective identifier being applied such that when the document is viewed in at least one of transmission and reflection the juxtaposition of the first background print and the first indicium is such that a keyline extending around at least a portion of the boundary of the first indicium is defined between the first indicium and the boundary of the indicium receiving area.

According to a further aspect of the invention there is provided a document of a series of documents which are identical in content except for a respective identifier which uniquely identifies each document within the series, each identifier comprising at least a first indicium, the or each indicium defining a boundary;

the document comprising:

a substrate;

a first background print provided on the substrate, the first background print defining at least part of the boundary of an indicium receiving area;

the respective identifier provided on the substrate, such that the first indicium is provided in the indicium receiving area;

the first background print and the respective identifier being provided such that when the document is viewed in at least one of transmission and reflection the juxtaposition of the first background print and the first indicium is such that a keyline extending around at least a portion of the boundary of the first indicium is defined between the first indicium and the boundary of the indicium receiving area.

Thus, the inventors have recognised that using the juxtaposition of two separate printed features to form keylines wholly or partly around identifiers which vary from document to document leads to a strong anti-counterfeiting effect.

In the methods and documents discussed above a keyline around an indicium in the identifier of a document is created by the juxtaposition or contrast between two separate features: the first background print and the first indicium of the identifier. This keyline may be readily observed by a person or machine authenticating the document.

Accurate provision of the keyline requires accurate registration (i.e. corresponding or relative positioning) between the separate first background print and the identifier. Any discrepancy in the position of the first indicium and the first background print will affect the appearance of the keyline and will be readily observed. This high level of registration requires highly accurate manufacturing techniques which are not available to many would-be counterfeiters. Therefore, documents manufactured according to the present invention offer increased security since they may be easily authenticated and are more difficult to counterfeit.

As such, the present methods and documents can be compared to conventional documents which use identifiers such as serial codes and serial numbers. In conventional documents an identifier can distinguish one document from another, but the identifiers are not appreciated by the public or manufacturers to provide any further security effect. In contrast, documents manufactured according to the present invention provide increased security and easy authentication, as discussed above.

A keyline is an outline or boundary line separating two features on a document. Thus the keyline will follow the contour of at least a portion of the first indicium.

The keyline separates the first indicium from the first background print, and therefore provides a border around at least a portion of the first indicium. In particularly preferred embodiments the first indicium and the first background print are applied such that the keyline exhibited by the device is visible to an unaided human observer—i.e. the keyline is preferably visible to the unaided or naked eye. Therefore a person may determine whether a document is genuine without the need for additional equipment or detection equipment.

As discussed above, the identifier provided to each document in the series of documents is unique. For instance the identifier may comprise a plurality of indicia, such that the combination and/or order of indicium in each identifier is unique. As the identifier changes between documents the first indicium, and therefore the boundary of the first indicium, may also vary. As an example, where the identifier is alphanumeric the first indicium may change from a "0" to a "1" between an adjacent or sequential pair of documents in the series.

Where the boundary of the first indicium is varied between documents in the series, the boundary of the indicium receiving area in which the indicium is provided must also be varied in order to maintain a keyline (i.e. an outline or boundary line) around the first indicium. In other words, since the keyline is created by the juxtaposition of the first indicium and the boundary of the indicium receiving area, as the boundary of first indicium changes between documents the boundary of the indicium receiving area and the first background print which defines the boundary of the indicium receiving area must also be varied between documents to correctly define the keyline.

Therefore, in the present invention the identifier and the first background print (and the indicium receiving area defined by the first background print) must be varied between documents in the series to correctly generate a keyline on each document. Consequently, the traditional methods of replicating identifiers that are used by counterfeiters are insufficient and unsuitable to imitate the appearance of documents in accordance with the present invention—where the first background print, the indicium receiving area and the keyline all vary in accordance with the unique identifier applied to the document. As such, imitating documents according to this invention will require an unauthorised reproducer to devote considerably more time, effort and expenditure than would be required for the reproduction of standard identifiers used on conventional documents (e.g. multi-character serial codes). Hence, the documents and methods in accordance with the present invention offer increased security.

The printed features discussed above are preferably provided using digital printing methods and systems. It is also possible to use more traditional offset printing methods. However, using offset printing would be expensive and time consuming for a would-be counterfeiter since a large variety of printing plates or drums must be created for the necessary variations in the print workings. Therefore the security of a document and series of documents manufactured by the methods discussed herein is increased.

In more detail, a potential counterfeiter is likely to have problems in obtaining the digital printing equipment of sufficient quality to economically reproduce documents with the necessary accuracy. Furthermore, due to the need to vary the physical extent of the background print, an illicit reproducer cannot only use, either wholly or partly, a commercially available number box to simply stamp an identifier onto a document with a fixed background image. In addition, regardless of the printing process used it will be difficult for an unauthorised reproducer to achieve the necessary registration between the first background print and the first indicium in order to create an accurate keyline.

If the reproduction is not of high quality, a fraudulent copy of a document will be readily detectable. The variations in identifier and the boundary of the indicium receiving area defined by the first background print which are necessary to define a keyline, and the accurate registration being required between these features, will render attempts at high quality unauthorised copying uneconomic. Therefore, the security of a given document and a series of documents is increased.

In preferred embodiments, the keyline is a line of constant (or substantially constant) lateral dimension. This effect is created where the boundary of the indicium receiving area is parallel to the boundary of the first indicium. However, this is not essential, and in some embodiments the width of the keyline around an indicium may vary either continuously or discontinuously (such that the width of the keyline around a first portion of the indicium may be wider or narrower than the width of the keyline around a second portion of the indicium).

By "defining" it is understood that the boundary of the indicium receiving area and the boundaries of the keyline may be formed by the boundary of the background print (e.g. such that there is no ink provided between the boundary of the in the indicium receiving area and the indicium), or by a change in the properties of the ink applied to the substrate (e.g. such that a print applied in the indicium receiving areas—for instance an indicium receiving print which defines a region within which or upon which an indicium is applied—has a different colour, appearance or other properties when compared to the background print).

By the term "on" it is understood that a feature, layer, print or print working is applied in contact with or above the substrate. Consequently, "on" should not be understood to require that two features are strictly adjacent or in direct contact. In other words, where a feature is applied on the substrate (or another component of the document) further layers or features may be provided between the printed feature and the substrate.

"Lateral" is understood to mean extending in substantially the same plane as the document, i.e. in a direction perpendicular to a normal extending from either side of the substrate.

Preferably, the substrate is at least semi-transparent. In such embodiments the keyline may be visible extending around at least a portion of the respective indicia in at least transmission from the side of the substrate that the indicia is applied to.

By "at least semi-transparent" it is understood that the substrate (and any further layers applied to it in the region of the identifier) is at least translucent such that printed features applied to the first side of the substrate may be observed light in at least transmission from the second side of the substrate. Preferably the substrate is at least semi-transparent in the visible spectrum (i.e. between approximately 380 and 700 nm). These semi-transparent or transparent substrates may have a colour tint. In preferred embodiments the at least semi-transparent substrate transmits at least 20% of incident visible light, more preferably the at least semi-transparent substrate transmits at least 50% of incident visible light, more preferably still the substrate transmits at least 75% of incident visible light.

For instance, the substrate may comprise a plastic material, such as: polyethylene terephalate (PET), biaxially orientated polypropylene (BOPP), polycarbonate (PC), polyvinylchloride (PVC), polybutylene terephalate (PBT), nylon or acrylic. The benefits of plastics or polymers are that they are durable, waterproof, strong, tear resistant, and easily recyclable. In further embodiments, the substrate may be formed of any suitable alternative materials such as paper, fabric resin or glass.

The substrate may comprises a single layer (i.e. a monolithic substrate) or be a multi-layered substrate. Monolithic substrates are quick, cheap and easy to manufacture. In contrast, multi-layered substrates enable the creation of more complex structures. The sub-layers of a multi-layered substrate may be secured together by heat and/or adhesive.

The document may include one or more opacifying layers applied to or over the substrate. For instance, the background print may be an opacifying layer. These opacifying layers comprise an opaque, translucent or semi-opaque material (e.g. an ink or coating comprising a white or grey pigment, or a light-scattering material). In some embodiments multiple translucent or semi-opaque opacifying layers may be applied over one another in order to create a combined layer which is sufficiently or substantially visually opaque. Each individual opacifying layer may have an optical density in the range 0.1 to 0.5, more preferably 0.1 to 0.4, most preferably 0.1 to 0.3 (as measured on a transmission densitometer, with an aperture area equivalent to that of a circle with a 1 mm diameter—a suitable transmission densitometer is the MacBeth TD932).

In preferred examples the document may comprise a substantially transparent window or half window in an otherwise substantially opaque region of the document. Windows and half windows may be created by providing a region of transparent material (e.g. a transparent polymer insert) within an otherwise opaque substrate such as paper. Alternatively, where the substrate is a transparent or at least semi-transparent polymer which is made opaque by applying one or more opacifying layers to it, a transparent window or half window may be defined by omitting opacifying layers from either or both sides of the substrate.

The substrate or the document as a whole may comprise a variety of other layers including one or more: conductive layers to prevent static build up, protective layers intended to prevent or mitigate damage to or tampering with the print workings; adhesive layers; a transparent varnish potentially comprising a matting additive to reduce the gloss of the document and/or to prevent the documents sticking together when they are stacked; and spacing layers separating the layers and/or workings discussed above. These layers may be provided as part of a multi-layer substrate, between the substrate and the first and/or second background print, or over the first and/or second background prints relative to the substrate (i.e. such that the first and/or second background prints are between the substrate and the further layer).

Preferably, the method further comprises applying a second background print on the substrate, wherein the first background print and the second background print are applied to opposing sides of the substrate. Thus the appearance of the document from opposing sides of the document may be different as the first background print may be observed from a first side of the document and the second background print from the second side of the document. This is preferred when manufacturing doubled sided documents (e.g. banknotes), but is not essential.

In particularly preferred embodiments, the second background print defines said at least part of the boundary of the indicium receiving area. In other words, the first and second background print each define a congruent part of the boundary of the indicium receiving area. For instance, the first and second background prints may have the same boundaries (i.e. extend over congruent regions of the substrate or document) or share a congruent boundary at least where the indicium receiving area is defined. Alternatively, the second background print may define a different part of the boundary of the indicium receiving area (in which case a keyline which extends around a different portion of the boundary of the first indicium may be observed between the boundary of the indicium receiving area defined by the second background print and the first indicium from at least one side of the substrate). Alternatively, the second background print may not define the indicium receiving area.

These features are particularly preferred where the substrate is at least semi-transparent. In which case, when the document is viewed from the side of the substrate to which the first background print is provided, the juxtaposition of the first background print and the first indicium creates a keyline extending around at least a portion of the boundary of the first indicium. Whereas, when the document is viewed from the side of the substrate to which the second background print is provided, the juxtaposition of the second background print and the first indicium creates a keyline extending around at least a portion of the boundary of the first indicium. In other words, from one side of the document the first indicium will be observed surrounded wholly or partially by a keyline juxtaposed against the first background print, whereas from the opposing side of the document the first indicium will be observed surrounded wholly or partially by a keyline juxtaposed against the second background print.

In further examples in which the identifier comprises two or more indicia, the second background print may define at least part of the boundary of a second indicium receiving area and the identifier may be provided on the substrate such that a second indicium is provided in the second indicium receiving area. The second background print and the respective identifier may be applied such that when the document is viewed in at least one of transmission and reflection the juxtaposition of the second background print and the second indicium is such that a keyline extending around at least a portion of the boundary of the second indicium is defined between the second indicium and the boundary of the second indicium receiving area.

Alternatively, or additionally, where the substrate is at least semi-transparent, a portion of the second background print may be observed in transmission through the keyline from at least one side of the substrate (i.e. from the side of the substrate opposed to the side of the substrate to which the second background print is provided). For instance, where the boundary of the indicium receiving area is defined by the boundary of the first background print, the second background print may be observed through the gap between the first indicium and the first background print (i.e. through the keyline).

Alternatively or additionally, where the identifier comprises at least two indicia, the second background print may define at least part of a second indicium receiving area, and the respective identifier may be applied on the substrate such that a second indicium is provided in the second indicium receiving area. The second background print and the respective identifier may be applied such that when the document is viewed in at least one of transmission and reflection the juxtaposition of the second background print and the second indicium is such that a further keyline extending around at least a portion of the boundary of the second indicium is defined between the second indicium and the boundary of the second indicium receiving area. Where either of the background prints are substantially opaque the keyline extending round the first indicium and the keyline extending round the second indicium may only be observed from opposing sides of the substrate.

These complex document appearances which may be produced using a second background print are more difficult for a would-be counterfeiter to imitate and result in documents and document series of increased security.

The background prints, and identifiers are preferably printed using any suitable ink. Preferably the inks used to apply the identifier are substantially opaque such that the identifiers are easily observed in both reflection and transmission, but this is not essential. Alternatively the features may be applied to the document using any other suitable substance or application method.

The document may preferably comprise further print workings which are applied before, during or after the application of the first and second background prints and the identifier. These further print workings may include any further graphics, text, information, security devices, and so on necessary for a document to perform its function. For example a blank passport manufactured to the methods described above may be subsequently printed with the portrait and information of its bearer in a further print working. Alternatively, where the document is a banknote, the denomination or the issuing body may be applied over the first or second background print in a further print working.

The first background print and the identifier may be provided in a single print working or in multiple print workings. Furthermore, the first background print and the identifier may be applied sequentially in any order or simultaneously. The method may include applying two or more print workings of different colours which combine to form a coloured first background print, second background print and/or the identifier. For instance, four separate print workings may be applied sequentially or simultaneously on the substrate to form any of these features in CMYK. Alternatively, or additionally, all features applied to a first side of the substrate may be provided in a first print working, whereas all features applied to the opposing side of the substrate may be provided in a second print working.

Preferably, a first part of the respective identifier is applied on a first side of the substrate, and a second part of the respective identifier is applied on the second side of the substrate. In other words, the identifier is split into two parts, each of which is applied to an opposing side of the substrate. When the document is viewed in transmission through the substrate the two parts of the identifier are seen in combination as a whole. However, registering separate print workings applied to opposing sides of a document is difficult and any mis-registration between the different parts of the identifier will be readily observed. Therefore, such embodiments have increased security since unauthorised reproducers are further discouraged from imitating or tampering with the documents.

In preferred examples the first part of the identifier comprises a first part of the first indicium and the second part of the identifier comprises a second part of the first indicium. In other words, the first indicium is split into two parts and the first part (i.e. section or portion) of the first indicium is printed on the first side of the substrate, whereas the second part (i.e. section or portion) of the first indicium is printed on the second side of the substrate. When the document is viewed in transmission the two parts of the indicium are seen together in combination as a whole.

As in the examples discussed above, a keyline may be formed by the juxtaposition of the background print(s) and one or more parts of the first indicium. For instance, the keyline may extend wholly or partially around the first part of the first indicium and/or the second part of the first indicium. As an example, the keyline may extend across the break or split between the two parts of the first indicium.

Registering the two parts of the first indicium with the first background print and/or the second background print (if present) requires highly accurate printing equipment and methods which are not available to many would-be counterfeiters. Furthermore, errors in registration may be easily observed in the appearance of the keyline or the combined indicium. As such, the security of the documents is increased. In further examples the first indicium may be further divided into three or more parts distributed between the opposing sides of the substrate.

Alternatively or additionally, where the respective identifier comprises two or more indicia, the first part of the identifier and/or the second part of the identifier may comprise at least one indicium of said two or more two indicia. Therefore, where the identifier comprises multiple indicium (e.g. as in conventional serial codes or bar codes) at least one entire indicium may be applied to either side of the substrate. This again increases the security of the document as any mis-alignment or mis-registration between the indicia in the separate parts of the identifier can be easily observed.

In preferred embodiments the first part of the respective identifier visually contrasts with the second part of the respective identifier. For instance, the two parts of the respective identifiers may exhibit different colours, tints, transparencies, reflectivities, ink thickness or patterns. Alternatively the different parts of the respective identifier may have substantially the same visual appearance but vary in further properties (e.g. tactile, magnetic or further properties). Such differences may be readily observed when the document is inspected but are complicated to print. Therefore the difficulty of counterfeiting a document or a series of documents according to the present invention is increased.

In preferred embodiments the first background print and the identifier are applied on the same side of the substrate. For instance, the first background print and the identifier may be quickly and efficiently applied to the document in a single print working. Applying the first background print and the identifier on the same side of the substrate means that accurate registration between the boundary of the indicium receiving area and the first indicium can be achieved, and an accurate keyline extending wholly or partly around the indicium may be easily and simply produced.

However, this is not essential. In alternative embodiments the first background print and the identifier may be applied on opposing sides of the substrate. In such cases, a keyline formed by the juxtaposition of the first background print and the identifier will be seen in transmission through the substrate from the side of the document to which the first background print is applied.

Accurately registering printed features applied to opposing sides of a substrate is significantly more complicated than registering features applied to the same side of a substrate. For instance, in a sheet-fed process the substrate may be carefully rotated and re-positioned between print workings. Alternatively, in a web-fed process, printing equipment may be provided on either side of the web of substrate, or the substrate may be rotated between subsequent printing equipment on the same side of the web. Alternatively, printing equipment which can print to opposing sides of the same document simultaneously may be used. These additional steps and the equipment necessary to perform them results in an increase in the difficulty for a would-be counterfeiter to accurately reproduce the document or series of documents. Therefore, the security of the documents is increased.

In preferred embodiments, the first and/or second background print extends over a lateral area which is greater than or equal to twice the lateral area over which the first indicium extends, preferably greater than or equal to five times the lateral area over which the first indicium extends, preferably greater than or equal to ten times the lateral area over which the first indicium extends. Therefore, the juxtaposition between the indicium, keyline and background prints is readily observed and the documents are easily authenticated.

Preferably the first and/or second background print extends over at least 10% of the lateral area of the document, preferably at least 25%, more preferably at least 50%, more preferably still at least 75%. However, this is not essential. Additionally, or alternatively, the first and/or second background print may extend over at least 10% of the lateral area of the substrate, preferably at least 25%, more preferably at least 50%, more preferably still at least 75%. In such embodiments, the juxtaposition between the indicium, keyline and background prints is again readily observed and the documents may be easily authenticated.

Preferably the first indicium is visible in at least one of transmission and reflection from each of the opposing sides of the substrate. Furthermore, preferably the keyline is visible from each side of the substrate when the document is viewed in transmission and/or reflection. In particularly preferred embodiments the first indicium and keyline are visible from each side of the substrate in both transmission and reflection. This may be achieved using a transparent or semi-transparent substrate, and by controlling the layers and printed features applied to the substrate such that the document is transparent or semi-transparent across part of, or the whole of, the indicium receiving area.

In preferred embodiments the keyline extends around at least 15% of the boundary of the first indicium by length, preferably wherein the keyline extends around at least 30% of the boundary of the first indicium by length, more preferably wherein the keyline extends around at least 50% of the boundary of the first indicium by length, more preferably still wherein the keyline extends around at least 75% of the boundary of the first indicium by length.

As discussed above, the first indicium (and therefore the boundary of the first indicium) may vary between documents in the series. Therefore, the specific proportion of the boundary of a given indicium which is surrounded by a keyline may depend on the shape of the first indicium and its boundary. The keyline may extend around any external boundary of the first indicium or an internal boundary of the first indicium (i.e. a boundary between the indicium and any negative space or a void within the indicium).

In particularly preferred examples, the keyline extends around the entirety of the external boundary of the first indicium. In such embodiments the keyline completely surrounds the first indicium. The accurate registration between the first indicium and the first and/or second background prints necessary to define the keyline is difficult for a potential counterfeiter to achieve. Therefore, the security of the identifier, document and document series are increased.

Advantageously, the first and second background prints are arranged such that the keyline visually contrasts with the indicium and the first and/or second background print.

By visually contrasts it is understood that the keyline exhibits a different appearance to a viewer in comparison to the first indicium and the first and/or second background print in visible light (approximately between 400 nm and 700 nm). As such, the keyline is readily seen by a human or machine observer.

In particular, the keyline formed by the juxtaposition of the background prints and the indicia is preferably visible to an unaided human observer, without the need for any additional equipment or devices. In other words, the keyline is preferably visible to the naked eye. The observer may therefore quickly and easily judge the accuracy and quality of the printing used to apply the identifier and the first and/or second background prints and the registration of these printed features using the keyline. Therefore, a genuine document can be easily authenticated.

Preferably, the keyline exhibits a different colour or tint, transparency, reflectivity, or pattern than the first indicium, the first background print and/or the second background print. Alternatively, the keyline may have a different print thickness or textures than the first indicium or the background print. These properties are readily observed by human user or machine reader such that the document may be easily authenticated. Any other suitable variation in material or visual properties may also be used.

Preferably the keyline is unprinted on the first and/or second side of the substrate. In other words, the keyline is an unprinted region defined between the boundary of the indicium receiving area and the boundary of the first indicium on at least one side of the substrate. In such cases, the boundary of the indicium receiving area may be wholly or partially defined by a boundary of the first and/or second background prints, such that the boundary of the indicium receiving area and the boundary of the first and/or second background are collinear, and the gap between the boundary of the indicium receiving area and the first indicium (i.e. the keyline) is unprinted. This unprinted region of the document will provide a strong contrast with the printed background prints and printed identifiers. In particular, these embodiments typically comprise a keyline which exhibits a strong visual and/or tactile contrast with the printed features of the document. In addition, where the document comprises a transparent or at least semi-transparent substrate or the first indicium is provided in contact with or over a transparent insert in an otherwise opaque substrate, the unprinted keyline may form a transparent window which extends partially or wholly around the first indicium. These complex features are difficult to reproduce but are easily observed by an authenticator. Therefore, documents manufactured according to these embodiments offer increased security.

Alternatively, the method may comprise applying a print in the indicium receiving area, wherein preferably the print in the indicium receiving region is an indicium receiving print. An indicium receiving print is understood as a print on which an indicium is applied, or a print which defines an area or region in which an indicium may be provided. In particularly preferred embodiments an indicium receiving print may be provided between the boundary of the indicium receiving area and the first indicium, in which case the indicium receiving print will be observed within the keyline in at least one of reflection or transmission from one side of the substrate. The print in the indicium receiving area may be a continuation of the first and/or second background print, such that the boundary of the indicium receiving area is defined partially or wholly by a change in the properties (e.g. the colour, tint, ink thickness, surface finish, etc) of the first and/or second background print.

The print in the indicium receiving area preferably contrasts with at least one of: the first indicium; first background print; and second background print (if present). This contrast is preferably a visual contrast which is easily observed by an authenticator. As examples, an indicium receiving print may exhibit a different colour or tint, transparency, reflectivity, or pattern to the other printed features applied to the security device. The indicium receiving print may be applied in the same print working as one or more of the first indicium, first background region or second background region, or in a separate printing step.

In preferred embodiments the method further comprises applying microtext or a security pattern (e.g. guilloches) in the indicium receiving area. For instance, the print in the indicium receiving area, or the indicium receiving print may comprise microtext or a security pattern. Therefore, a strong contrast between the appearance may be achieved between the indicium receiving area and the keyline (defined between the first indicium and the boundary of the indicium receiving area), and the appearance of the first indicium and the first and/or second background regions, between which they are defined. Microtext and security patterns are complex printed features which require highly accurate printing equipment. This equipment is expensive and not available to many potential counterfeiters. Therefore, producing fraudulent documents may be uneconomic.

Alternatively or additionally, the documents may be arranged or configured such that the appearance of the keyline contrasts with the first indicium, the first background print and/or the second background print in a manner which cannot be observed in visible light (approximately between 400 nm and 700 nm). For instance, the keyline may offer a different tactile effect when compared to the first indicium that it extends around and/or a background print. Alternatively or additionally, the keyline may exhibit a different appearance from the first indicium, the first background print and/or the second background print in the ultraviolet spectrum (electromagnetic radiation between approximately 10 and 400 nm) or infrared spectrum (electromagnetic radiation between approximately 700 and 1050 nm). Additionally, or alternatively one or more of the printed features may be provided with fluorescent or luminescent materials or inks so that the keyline can be distinguished from the adjacent first indicium and background print(s) under specific incident light (e.g. incident UV light). Equally, one or more of the printed features may be provided with a thermochromic or magnetic material which may be detected and distinguished from the remaining features dependent on a change in temperature or with a specific detector, so as to determine whether the keyline has been accurately produced to the document.

It will be seen that many of the materials and effects discussed above are "covert"—i.e. not immediately apparent from inspecting the document under ambient visible light (i.e. electromagnetic radiation between approximately 380 nm and 700 nm). Therefore, in these examples the keyline forms a security feature which is not immediately apparent to a user and cannot be copied by a would-be counterfeiter using common reproduction equipment (e.g. photocopying or scanning). Consequently the document and series of documents are more secure. Instead, these documents may require further equipment or systems to verify the correct placement of the first indicium and the first and/or second background prints relative to one another.

Preferably the first indicium comprises at least one: letter; number; or symbol. Identifiers comprising such indicia (especially alphanumeric indicium) are readily understood by a user, allowing a user to easily distinguish each document in the series. Alternatively, any other sign or mark may be used.

In particularly preferred embodiments the identifier is an alphanumeric code (i.e. an identifier solely comprising numbers and letters). More preferably the identifier may be a serial code. In such embodiments one or more of the indicia of an identifier applied to a given document may be incremented or changed relative to the identifier applied to adjacent documents in the series. Therefore, the alphanumeric or serial codes of different documents may be easily compared (e.g. to determine whether a specific document has been fraudulently copied).

Alternatively, the unique identifier may be machine readable, solely comprising symbols, signs or glyphs the meaning of which may not be immediately apparent to a human viewer. For instance, the identifier may be a bar code (in which the bars form the symbols), a QR code or any other suitable code.

In preferred embodiments the first and/or second background print comprises: a region of uniform colour; a security pattern; an embossed latent image; a diffractive relief; an anti-scan pattern; a guilloche; a graphic; a photograph; an artwork; a symbol; a portrait; alphanumeric text; or an indicia. Such background prints may be required for the document to perform its wider function. For instance, a passport might comprise a photograph of its bearer, and alphanumeric text identifying the bearer. Preferably the background print(s) provide a strong contrast with the indicia and keylines.

Preferably the keyline has a width of at least 25 μm, preferably at least 50 μm, more preferably at least 100 μm. Preferably the keyline has a width of at most 2 mm, preferably at most 1 mm, more preferably at most 0.5 mm. These widths are defined by the distance between the boundary of the indicium receiving area and the first indicium. A skilled person will recognise that the keylines of the present invention may have substantially any width, and that the width of a keyline in a specific series of documents may be decided based on the size of the indicium around which the keyline extends and based on the typical use of the document (so that the keyline may be readily observed extending around the indicium by an observer during authentication or normal use). A keyline of smaller width is more difficult to register (since higher accuracy is required when positioning the first indicium and background print(s) relative to one another), but is more difficult to observe. Good results may be achieved for a wide range of documents using keylines between 25 μm and 2 mm in width. The keylines in these examples are sized such that the keylines may be visible to an unaided human observer (i.e. where the keyline is visible to the naked eye). Therefore a human authenticator may easily determine whether a document is genuine without the need for additional equipment or detection equipment. Preferably the keyline is of an approximately constant width at all points as it surrounds the first indicium—i.e. the boundary of the indicium receiving area is substantially parallel to the portion of the boundary of first indicium around which the keyline extends. In particularly preferred embodiments the keyline does not vary in width by more than 25%, more preferably not by more than 10%. In such cases any inaccuracy in the relative positioning of the first indicium and the background print(s) will be readily seen when inspecting the keyline (since the keyline is defined by the juxtaposition of the first indicium and the background print(s)). Therefore, any reduction in production quality, as may be expected for imitation or counterfeit documents, will be immediately observed. Therefore, the security of the document and the series of documents will be increased.

Preferably, the first indicium, first background print and/or second background print are digitally printed, preferably using one of: inkjet printing; laser printing; dye sublimation; or xerography. Where present, a print in the indicium receiving area (such as an indicium receiving print) is also preferably digitally printed, more preferably using one of: inkjet printing; laser printing; dye sublimation; or xerography. Digital printing—where an image is printed directly to a document or other media—is particularly attractive since the printed features may be changed between adjacent documents in the series of documents without changing a plate or drum (as would be required with traditional offset methods such as intaglio, gravure and lithographic printing). Therefore, digital printing techniques significantly reduce the time, materials and cost required to create a series of documents manufactured to the methods discussed above. Nevertheless, substantially any printing method including any digital or offset printing method (and the corresponding systems and equipment) may be used to produce a document according to the present invention.

Preferably the first background print and the identifier are applied in the same print working (i.e. in the same printing step or process). This is particularly preferred when the first background print and the identifier are applied to the same side of the substrate, but is not essential.

In alternative embodiments the second background print and the identifier are applied in the same print working (i.e. in the same printing step). This is particularly preferred when the first background print and the identifier are applied to the same side of the substrate, but is not essential.

More broadly, it will be appreciated that the first background print and the first indicium may be applied sequentially as parts of separate print workings or simultaneously in the same print working. Equally, the second background print and the first indicium may be applied sequentially as parts of separate print workings or simultaneously in the same print working. Where present, any print in the indicium receiving area, such as an indicium receiving print, may be applied in the same working as one or more of the first background print, second background print and the identifier.

The first background print and the second background print may be applied sequentially or simultaneously. By simultaneously it will be understood that he first and second background prints will be applied as separate print workings in contact with or above opposing sides of the substrate at substantially the same time. Further, where these features are applied to the document sequentially, they may be applied in any order. In any of these cases the features may be applied as part of a sheet-fed printing step or a web-fed printing step. In particularly preferred embodiments the first and second background prints may be applied to opposing sides of a document substrate substantially simultaneously. Where the printed features are applied sequentially it may be difficult to achieve the necessary registration between the first indicium and the indicium receiving area defined by the background prints, especially between the indicium and a background print which are applied to opposing sides of the substrate. However, such machines are expensive. Thus unauthorised reproduction of the documents is made less economic and unattractive for would-be counterfeiters.

Additionally, the inventors have recognised that, in a series of documents each of which is identified by a unique identifier, using the juxtaposition of two separate printed features to form keylines wholly or partly around two or more of the indicia of the identifier which vary from document to document in a series of leads to a stronger anti-counterfeiting effect.

In preferred embodiments, each identifier comprises two or more indicia, each indicium defining a boundary;

wherein the first background print defines at least part of the boundary of a first indicium receiving area and a second indicium receiving area;

wherein the identifier is applied such that a first indicium is provided in the first indicium receiving area and a second indicium is provided in the second indicium receiving area;

the first background print and the respective identifier being applied such that when the document is viewed in at least one of transmission and reflection the juxtaposition of the first background print and each of the first and second indicia is such that a keyline extending around at least a portion of the boundary of each of the first and second indicia is defined between the first and second indicia and the respective indicium receiving area.

Therefore, both the first and second indicia are observed surrounded wholly or partially by a keyline due to the juxtaposition between the first background print and the first and second indicia. Any mis-registration or errors in the relative location of the first and second indicia, or the first background region (and the first and second indicium receiving areas defined by the first background region) will be immediately obvious to an observer (e.g. an unaided human observer). Furthermore, the difficulty of producing such documents is increased. Hence, fraudulent copies of the document can be easily detected and the security of the document series is increased.

The first and second indicium receiving areas may be separate and laterally spaced from one another. This is particularly preferable where a keyline extends around the entirety of the first and second indicia (i.e. the first and second indicia are each entirely surrounded by a keyline). Alternatively, the first and second indicium receiving areas may be the same indicium receiving area, in which both the first and second indicia are provided. In other words, the first background print may define a single indicium receiving area, and the identifier may be applied such that the first and second indicia are provided in the single indicium receiving area. In this case a keyline may be defined between a portion of the boundary of each of the first and second indicia, and different portions of the boundary of the single indicium receiving area.

In these embodiments the document may further comprise any of the additional features discussed above. For instance, the document may comprise a second background print and/or at least one indicium receiving print which may be observed in the keyline surrounding the first and/or second indicia. The second background print and the indicium receiving prints may comprise any of the features discussed above with reference to these components.

The first and second indicia, and the keyline surrounding each indicium may exhibit similar or different appearances. For instance, the first indicium may exhibit a red tint and be surrounded wholly or partially by a blue keyline, whereas the second indicium may exhibit a blue tint and be surrounded wholly or partially by a red keyline. The extent to which each indicium is surrounded by a keyline may also vary (i.e. the first indicium may be wholly surrounded by a keyline, whereas the second indicium may only be partially surrounded or bordered by a keyline).

Each of the indicia in such an embodiment may comprise any of the features discussed above with reference to first indicium. Each of the plurality of indicium receiving areas may comprise any of the features of the indicium receiving area in which the first indicium is received, as discussed above. Furthermore, the first background print may comprise any of the features discussed in reference to earlier embodiments above.

Nevertheless, although the appearance and properties of first and second indicia and their respective keylines may vary relative to the other indicia within the document, they should remain constant between documents in the series of documents. For instance, the appearance of the first indicium and the respective keyline extending around the first indicium should be the same in every document of the series of documents, regardless of the specific value, mark or sign of the first indicium (which may vary in accordance with variations in the unique identifier).

In particularly preferred embodiments, each identifier comprises a plurality of indicia, each indicium defining a boundary;

wherein the first background print defines at least part of the boundary of a plurality of indicium receiving areas;

wherein the respective identifier is applied such that each indicium is provided in an indicium receiving area of said plurality of indicium receiving areas;

the first background print and the respective identifier being applied such that when the document is viewed in at least one of transmission and reflection the juxtaposition of the first background print and each indicium is such that a keyline extending around at least a portion of the boundary of each indicium is defined between each indicium and the indicium receiving area in which it is provided.

In this embodiment each indicium is wholly or partially surrounded by a keyline which extends around the boundary of the indicium. Again, inaccuracies or errors in the production of such a document can be immediately observed by inspecting the keyline and the difficulty of manufacturing such a document is increased. Therefore, the security of the document and the document series is increased.

The indicium receiving areas may each be separate and laterally spaced from one another. This is particularly preferable where a keyline extends around the entirety of the first and second indicia (i.e. the first and second indicia are each entirely surrounded by a keyline). Alternatively, two or more indicia may be provided in a single indicium receiving area. In this case a keyline may be defined between a portion of the boundary of each indicium within the single indicium receiving area, and different portions of the boundary of the single indicium receiving area.

The document may further comprise any of the additional features discussed above. For instance, the document may comprise a second background print and/or at least one indicium receiving print which may be observed in the keyline surrounding an indicia. The second background print and the indicium receiving prints may comprise any of the features discussed above with reference to these components.

The indicia and the keylines surrounding each indicium may exhibit similar or different appearances. For instance, each of the indicia may be surrounded by an unprinted keyline. Alternatively, the different keylines and indicia keyline may exhibit different colours, tints, transparencies, reflectivities, ink thickness or patterns. For instance, a first indicium may exhibit a red tint and be surrounded by a blue keyline, whereas a second indicium may exhibit a blue tint and be surrounded by a red keyline. The extent to which each indicium is surrounded by a keyline may also vary (i.e.

a first indicium may be wholly surrounded by a keyline, whereas a second indicium may only be partially surrounded or bordered by a keyline).

Each of the indicia may comprise any of the features discussed above with reference to first indicium. Each of the plurality of indicium receiving areas may comprise any of the features of the indicium receiving area in which the first indicium is received, as discussed above. Furthermore, the first background print may comprise any of the features discussed in reference to earlier embodiments above.

Nevertheless, although the appearance and properties of indicia and their respective keylines may vary within a given document, the appearance of properties of a given indicia should remain constant between documents in the series of documents. In other words, the appearance of a given indicia and its respective keyline should be the same in every document of the series of documents, regardless of the specific value, mark or sign of the given indicia (which may vary in accordance with variations in the unique identifier).

In preferred embodiments the document is a security document. A security document is a document that secures value and is provided with anti-counterfeiting or other protective devices. For instance, the security document may comprise one or more security devices such as a hologram, lenticular device, moiré device, or magnetic or fluorescent material, and/or comprise one or more security articles such as a security thread, strip, or insert which themselves may comprise one or more security devices. Documents without such security devices or security articles are not typically considered security documents. The value provided by a security document may be intrinsic (e.g. a banknote, cheque, credit cards or similar) or be defined by the value of the document to a bearer (e.g. identity cards, drivers license, passports and the like).

In particular the document may be a banknote, cheque, identification document, certificate, share, stamp, visa, passport, license, bank card, or ID card. These security documents are frequently the target of counterfeiters wishing to make fraudulent copies thereof and/or changes to any data contained therein. Therefore, providing security documents with the identifiers, indicia, keylines discussed above offers clear benefits to document security.

According to a further aspect of the invention there is provided a method of manufacturing a series of documents which are identical in content except for a respective identifier which uniquely identifies each document within the series, each identifier comprising at least a first indicium, the or each indicium defining a boundary;

the method of manufacturing each document comprising the steps of:

providing a substrate;

applying a first background print on the substrate, the first background print defining at least part of the boundary of an indicium receiving area;

applying the respective identifier on the substrate, such that the first indicium is provided in the indicium receiving area;

the first background print and the respective identifier being provided such that when the document is viewed in at least one of transmission and reflection the juxtaposition of the first background print and the first indicium is such that a keyline extending around at least a portion of the boundary of the first indicium is defined between the first indicium and the boundary of the indicium receiving area.

As such, this aspect of the invention is directed to producing a series of documents. Each of these documents is manufactured to the methods discussed above. Therefore, each document in the series of documents and the series of documents as a whole offer the advantages discussed above with reference to the earlier aspects of the invention.

According to a further aspect of the invention there is provided a document manufactured according to the methods of manufacturing a document discussed above. These documents provide increased security and are more difficult for would-be counterfeiters to imitate or modify.

According to a further aspect of the invention there is provided a series of documents, each of which is manufactured to the methods of manufacturing a series of documents discussed above. This series of documents offers increased security and substantially to increases the difficulties faced by the unauthorised reproducer of such documents.

According to a further aspect of the invention there is provided a series of documents which are identical in content except for a respective identifier which uniquely identifies each document within the series, each identifier comprising at least a first indicium, the or each indicium defining a boundary;

each document comprising:

a substrate;

a first background print provided on the substrate, the first background print defining at least part of the boundary of an indicium receiving area;

the respective identifier provided on the substrate, such that the first indicium is provided in the indicium receiving area;

the first background print and the respective identifier being provided such that when the document is viewed in at least one of transmission and reflection the juxtaposition of the first background print and the first indicium is such that a keyline extending around at least a portion of the boundary of the first indicium is defined between the first indicium and the boundary of the indicium receiving area.

DETAILED DESCRIPTION

Figure 1A:
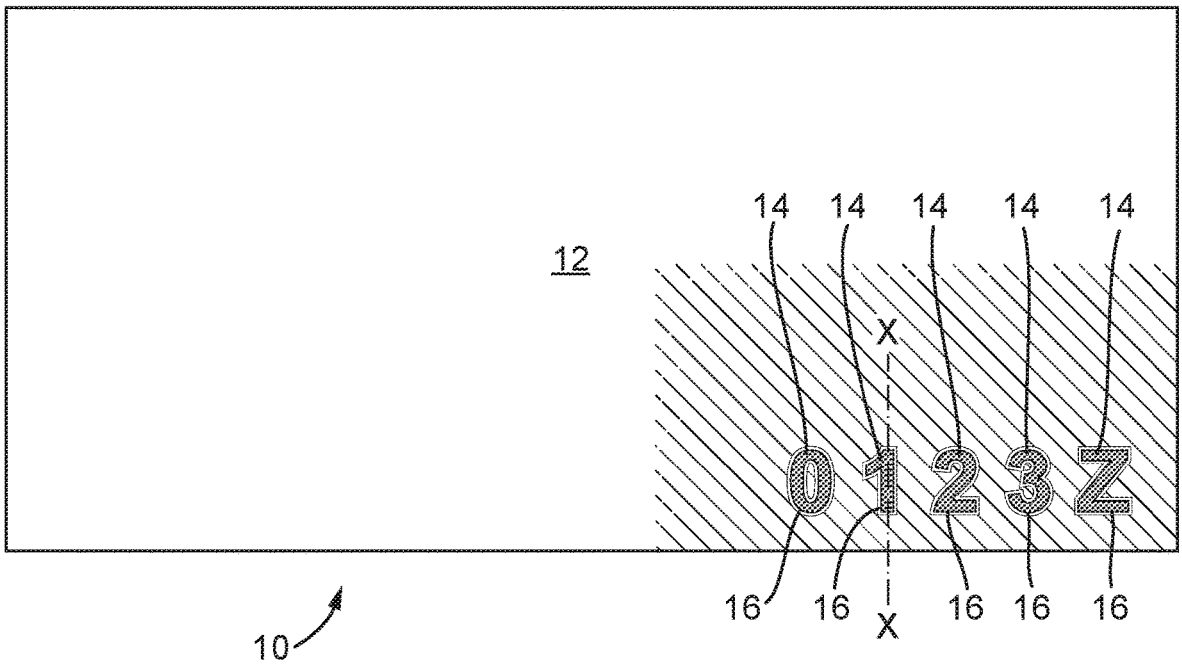
FIG. 1*a* shows a diagrammatic representation of a face of a document in accordance with the present invention in which only a unique identifier, background print and keylines are illustrated.

FIG. 1*a* shows a document 10 which is provided with a background print 12 and an identifier in accordance with the present invention. The document 10 is part of a series of documents 10 which are identical in content except for the identifier, which is unique to the specific document 10 shown.

The identifier comprises five laterally spaced indicia 14. These indicia 14 are alphanumeric and, as will be seen from the figure, the identifier applied to the illustrated document reads "0123Z".

Each of the indicia 14 are surrounded by a keyline 16 which extends around the entire boundary of the respective indicium 14. The keylines 16 separate the indicia 14 from the first background print 12 and appears juxtaposed between the background print 12 and the indicia 14. Notably, the indicium "0" also has an internal void, and a keyline 16 extending around the boundary of this internal void. However, this is not essential and in alternative documents an internal void within an indicium 14 may not be provided with a keyline 16.

Figure 1B:
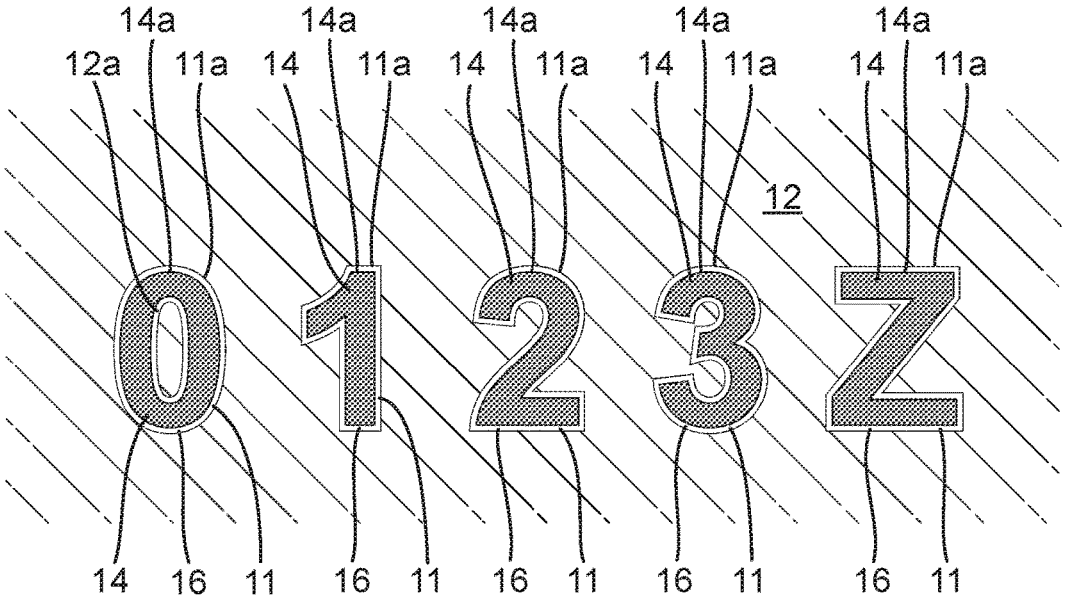
FIG. 1*b* shows a portion of the face of the document of FIG. 1*a* in more detail.
Figure 1C:
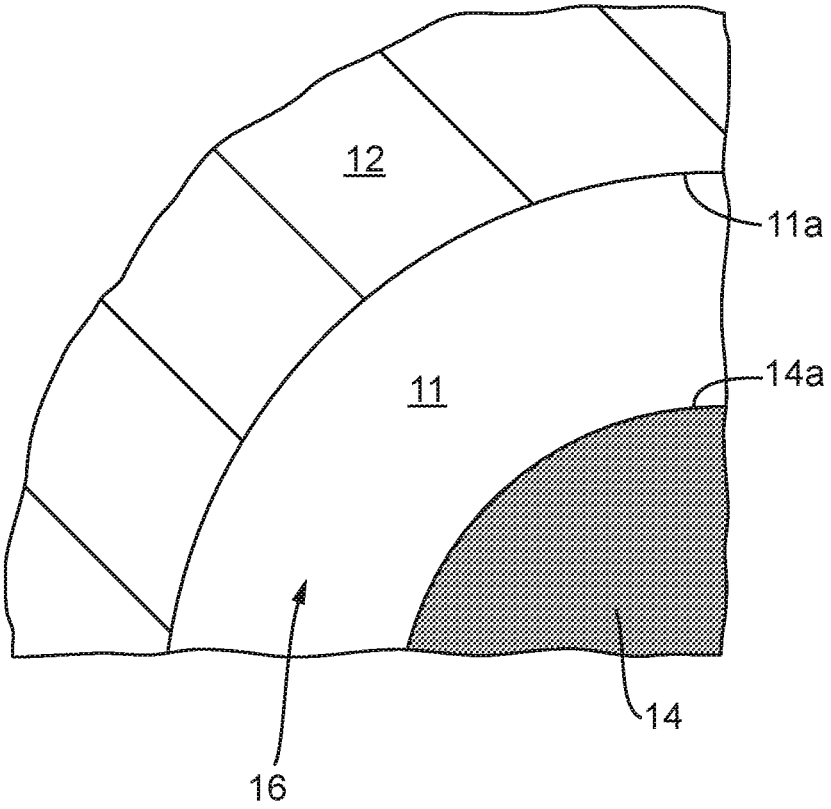
FIG. 1*c* shows a portion of the face of the document of FIGS. 1*a* and 1*b* in further detail.

The portion of document 10 is shown in more detail in FIG. 1*b*, and even closer in FIG. 1*c*. As shown, the background print 12 defines the boundaries 11*a* of five laterally spaced indicium receiving areas 11, corresponding to the five indicia 14. Each indicium 14 is provided within a corresponding indicium receiving area 11. As will be seen the boundary 11*a* of each indicium receiving area 11 is substantially parallel to the boundary 14*a* of the respective indicium 14, and together the boundary 11*a* of each indicium receiving area 11 and the boundary 14*a* of the respective indicium 14 define a keyline 16 (i.e. a boundary or contour line) of substantially constant thickness which extends around the entire boundary 14*a* of the respective indicium 14. Thus the keylines 16 are formed through the juxtaposition or contrast between the first background print 12 and the indicia 14.

No details of the background print 12 are illustrated in FIGS. 1*a*, 1*b* and 1*c*. However, substantially any image, symbols, text or graphics may be provided as part of the background print 12 to enable the document 10 to perform its function. For instance, if the document 10 were a banknote the background print 10 may include the denomination of the banknote, the name of the bank or body issuing the banknote and a variety of further security devices. As shown, the background print is hatched and these hatching do not extend over the entire extent of the document. However, as will be readily appreciated, the background print 12 can extend over substantially any proportion of the lateral area of the document 10 so long as it defines the indicium receiving areas 11 as discussed above. Furthermore, it will be appreciated that the background print of a document, such as the background print 12 shown in FIGS. 1*a*, 1*b* and 1*c*, may be formed of multiple prints or print workings that are applied over one another.

In a series of the documents 10 shown in FIG. 1 each document 10 will be provided with a unique identifier. Therefore, at least one indicia 14 forming the identifier will be changed between adjacent documents 10 in the series. For instance, a consecutive or adjacent document to the document 10 shown in FIG. 1 may be provided with an identifier reading "0124Z", "0123k", or any other unique identifier. As will be appreciated, the boundaries of the indicia 14 in an identifier applied to any given document 10 in the series will be different from the boundary of the indicia 14 in the identifiers applied to the remaining documents 10 in the series.

Since the boundary 14*a* of at least one indicium 14 changes between adjacent documents 10 in the series, the boundary 11*a* or boundaries 11*a* of the corresponding indicium receiving area(s) 11 must also change between the adjacent documents 10 to maintain keylines 16 which accurately follow the boundaries 14*a* of the indicia 14. Therefore, although the content of the documents 10 does not vary between individual documents 10, the extent of the indicium receiving areas 11 will vary, and as such the first background print 12 (which defines the boundaries 11*a* of the indicium receiving areas 11) must also be varied between documents. Therefore the difficulty of reproducing documents 10 in the series is increased.

Although all of the indicia 14 shown in FIGS. 1*a*, 1*b* and 1*c* are provided with keylines 16 in alternative embodiments an indicium receiving area 11 and keyline 16 may only be defined around a single indicium 14 of the identifier (or even only around a portion of a single indicium 14 of the identifier). In such documents 10, there is no need to vary the background print 12 unless the indicium 14 provided with the keyline 16 is changed (i.e. a boundary of the indicium 14 provided with a keyline 16 changes).

For instance, if only the first indicium 14 of a five digit identifier (e.g. the "0" of the identifier "0123Z" shown in FIG. 1) is surrounded by a indicium receiving area 11 (i.e. a single keyline 16 is defined around the "0" by the juxtaposition of the indicia "0" and the background print 12), it is only necessary to vary the background print 12 and the boundary 11*a* of the indicium receiving area 11 defined by the background print 12 when the first indicium 14 changes (e.g. when the background print 12 is changed from "0123Z" to "1123Z", but not from "0123Z" to "0123A").

Nevertheless, even if a keyline 16 is provided only to a single indicia 14 or a subset of the indicia 14 in an identifier, the number of background prints 12 which must be printed is increased relative to a series of documents 10 without a keyline 16. Furthermore, in these embodiments there is still a requirement to accurately register the background print 12 and each indicium receiving area 11 to the indicia 14 to correctly define the keyline(s) 16. Each of these requirements increases the difficulty of imitating the series of documents 10 for a counterfeiter.

The document 10 shown in FIG. 1 (which as discussed above includes keylines 16 formed by the juxtaposition of the indicia 14 and the first background print 12) may be created by a wide variety of document structures. Examples of these structures will now be discussed with reference to FIGS. 2*a* to 2*l* which show alternative cross sections of the document 10 along line X-X (as shown in FIG. 1*a*).

In FIGS. 2*a* to 2*l* the documents 10 each comprise: a substrate 18 with opposed first and second sides 18*a*, 18*b*, a first background print 12 applied to a first side 18*a* of the substrate 18; an indicium receiving area 11, the boundary 11*a* of which is defined by the first background print 12; and an indicium 14, the number "1", as shown in FIGS. 1*a* and 1*b*.

The lateral extent and relative lateral positioning of the first background print 12, the indicium receiving area 11 and the indicium 14 are identical in each of the cross sections of FIGS. 2*a* to 2*l*. However, different appearances and effects of document 10 may be achieved through the provision of further features and changes to the position of the features relative to the substrate 18 (i.e. in a direction normal to the surfaces 18*a*, 18*b* of the substrate 18 and the document 10, and perpendicular to the lateral directions parallel to the surfaces 18*a*, 18*b* of the substrate 18 and the document 10), as discussed below.

Figure 2A:
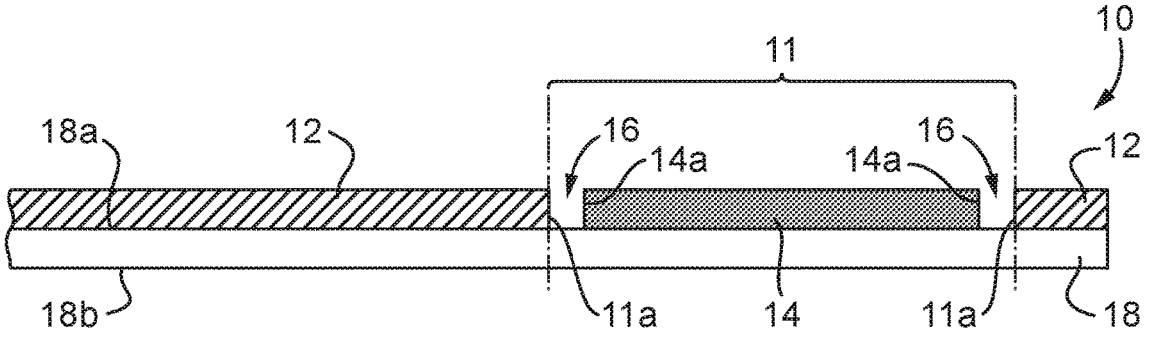
FIGS. 2*a* to 2*l* show alternative cross sections in accordance with the present invention through the document shown in FIG. 1 along line X-X.

FIG. 2*a* shows a portion of a document 10 in cross section. The document 10 comprises a substrate 18 with opposed first and second sides 18*a*, 18*b*. On a first side 18*a* of the substrate 18 are provided a background print 12 and the indicium "1" of the identifier "0123Z" shown in FIGS. 1*a* and 1*b*. The boundary of the background print 12 defines the boundary 11*a* of an indicium receiving area 11. As such, the boundary of the background print 12 and the boundary 11*a* of the indicium receiving area are congruent and have the same lateral position by definition. The indicium 14 is provided in (i.e. received within, positioned within) the indicium receiving area 11 such that the indicium receiving area 11 entirely surrounds the indicium 14. The indicium receiving area is unprinted between the boundary of the background print 12 and the boundary 11*a* of the indicium receiving area 11 on both sides 18*a*, 18*b* of the substrate 18.

Therefore, when viewed from the first side 18*a* of the substrate 18, the indicium 14 will be seen (i.e. observed) against the first background print 12 and surrounded by an unprinted keyline 16 extending around its boundary. The unprinted keyline 16 may be easily visually distinguished from the printed indicium 14 and background print 12, especially if the indicium 14 and background print 12 are printed with tinted or at least semi-opaque inks. If the substrate 18 is at least semi-transparent the background print 12, indicium 14 and keyline 16 may also be observed in transmission from the second side of the substrate 18, and where the substrate is substantially transparent the keyline 16 is defined by a transparent window through the document 10.

Since the keyline 16 may be easily distinguished from the indicium 14 and the background print 12, any errors in registration between the background print 12 and indicium 14 (as might be introduced in a counterfeiting process) will be easily observed.

The document 10 of FIG. 2*a* may be manufactured by printing the background print 12 and the indicium 14 in separate steps—i.e. where the background print 12 and the indicium 14 are sequentially applied in separate first and second print workings. Alternatively, the background print 12 and the indicium 14 may be applied simultaneously in a single, combined print working.

Figure 2B:
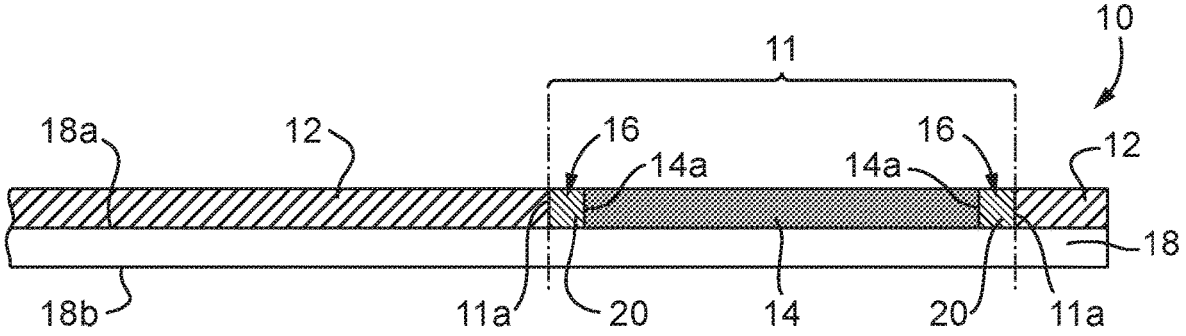

FIG. 2*b* shows an alternative structure for the document 10 of FIG. 1 which again exhibits keylines 16 extending around (i.e. surrounding) indicia 14, as shown in FIG. 1.

Unlike in FIG. 2*a* the keyline 16 of FIG. 2*b* is not unprinted and instead the document 10 is provided with an indicium receiving print 20 on the first side 18*a* of the substrate 18. The indicium receiving print 20 is provided between the boundary 14*a* of the indicium 14 and the boundary of the indicium receiving area 11*a* (i.e. between the indicium 14 and the background print 12) and therefore forms the keyline 16 extending around the indicium 14. In other words the indicium receiving print 20 is provided to the regions of the indicium receiving area 11 in which the indicium 14 is not located, so as to form a printed keyline 16. Thus, the keyline 16 will exhibit the appearance of the indicium receiving print 20. The indicium receiving print 20 may differ from the indicium 14 and the background print 12 in appearance by (for instance) colour, tint, transparency, reflectivity, pattern, texture, thickness and/or another observable property. Therefore, the printed keyline 16 may be easily compared to the indicium 14 and background print 12.

In this example it will be seen that the boundary 11*a* of the indicium receiving region 11 may be defined by variations in the inks or other properties between the indicium receiving area 11 and the first background pint 12, and/or the boundary 14*a* of the indicia 14 may be defined by the variation in inks or other properties between the indicia 14 and the indicium receiving area 11.

For instance, the indicium receiving print 20 may be applied in the same print working with the background print 12 and/or the indicium 14—e.g. the three components may be different parts of a continuous printed layer applied across the first side 18*a* of the substrate 18, each part of which has a different ink composition. Alternatively, these features may be applied in separate print workings.

Figure 2C:
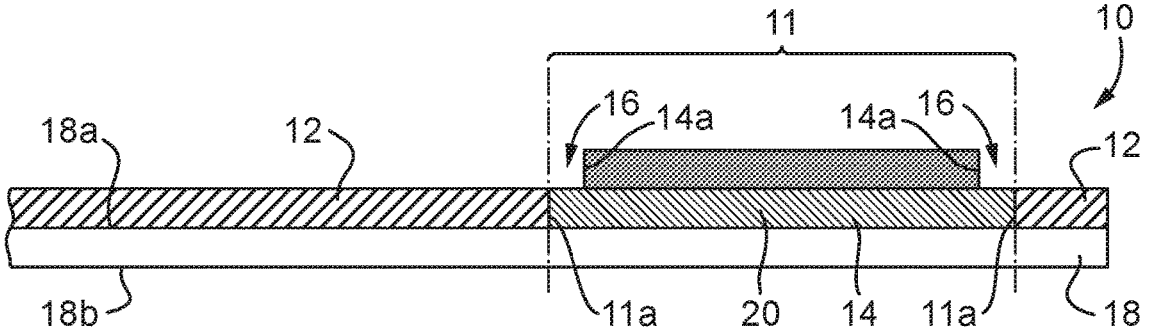

FIG. 2*c* shows a document 10 which comprises a background print 12 and an indicium 14 provided to the first side 18*a* of a substrate 18. The background print 12 defines an indicium receiving area 11. An indicium receiving print 20 is provided within the indicium receiving area 11 on the first side 18*a* of the substrate 18 and extends across the whole of the indicium receiving area 11. The indicium 14 is positioned laterally within the indicium receiving area 11 defined by the background print 12 and over the indicium receiving print 20 relative to the substrate 18 (i.e. such that the printed keyline region 20 is provided between the indicium 14 and the substrate 18).

Assuming the indicia 14 of the document 10 is substantially opaque (e.g. opaque to light in the visible spectrum), when viewed from the first side 18*a* of the substrate 18 the document 10 of FIG. 2*c* will exhibit a similar appearance to the document 10 of FIG. 2*b*—i.e. the substantially opaque indicium 14 will be observed surrounded by a printed keyline 16 (formed by the portion of the indicium receiving print 20 positioned laterally between the indicium 14 and the boundary of the indicium receiving area 11). The indicium 14 and the keyline 16 (which follows the boundary of the indicium 14, as shown in FIGS. 1*a*, 1*b* and 1*c*) will be seen against the background print 12. Additionally, if the indicium 14 of FIG. 2*c* is at least semi-transparent, the printed keyline region 20 may be observed through the indicia 14 when viewed from the first side 18*a* of the substrate.

From the second side 18*a* of the substrate 18, the indicium 14 will be seen in transmission through the indicium receiving print 20 if the indicium receiving print 20 and the substrate 18 are at least semi-transparent in combination.

Alternatively, the indicium 14 may not be visible from the second side 18*b* of the substrate 18 in the event that the indicium receiving print 20 and the substrate 18 are substantially opaque.

Figure 2D:
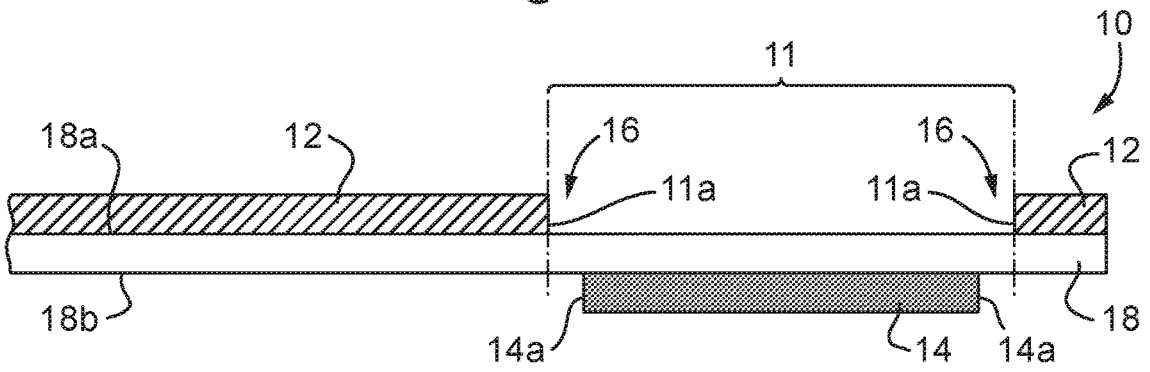

FIG. 2*d* shows a further example of a document 10 which exhibits keylines 16 extending around an indicium 14. The document 10 comprises a substrate 18 with opposed first and second sides 18*a*, 18*b*, and which is at least semi-transparent over at least the indicium receiving area 11. On the first side 18*a* of the substrate 18 is provided a first background print 12, whereas the indicium 14 is provided to the opposing second side 18*b* of the substrate 18.

The boundaries of the background print 12 define the boundaries 11*a* of an indicium receiving area 11 which, as shown, is unprinted on the first side 18*a* of the substrate. The indicium 14 is located laterally (i.e. in the directions of the plane of the document 10) within the indicium receiving area 11, as defined by the first background print 12. Therefore, an unprinted keyline 16 is defined around indicium 14 by the juxtaposition of the first background print 12 and the indicia 14, the keyline 16 extending between the boundary 14*a* of the indicia and the boundary of the indicium receiving area 11.

When viewed from either side 18*a*, 18*b* of the at least semi-transparent substrate 18 the indicium 14 will be seen against the background print 12, such that the background print 12 and indicium 14 are separated by the unprinted and substantially transparent keyline 16. This unprinted keyline 16 will exhibit the appearance of the substrate, and where the substrate is substantially transparent will form a transparent window which is particularly striking and readily observed by a human or machine observer, such that the document 10 can be quickly and easily authenticated. Preferably the indicium 14 and the background print 12 are configured such that the unprinted keyline 16 will be visible to a naked or unaided human eye such that it may be seen by a human observer without the need for additional equipment (however, this is not essential).

The indicium 14 and background print 12 may be applied as separate print workings to the opposing sides 18*a*, 18*b* of the substrate 18. These print workings may be applied simultaneously or sequentially as part of either a web-fed or sheet-fed process.

FIGS. 2*e* to 2*h* show further documents 10 which comprise two background prints 12, 22 applied respectively to the two opposing sides 18*a*, 18*b* of a substrate 18. These documents 10 may exhibit different appearances when viewed from either side 18*a*, 18*b* of the substrate 18 if the two background prints provide different appearances. These effects are particularly advantageous where the substrate 18 is transparent or semi-transparent across at least the indicium receiving areas 11 such that he indicium 14 can be observed from either side 18*a*, 18*b* of the substrate 18. In particular, the substrate 18 is preferably substantially transparent across its entire width.

Figure 2E:
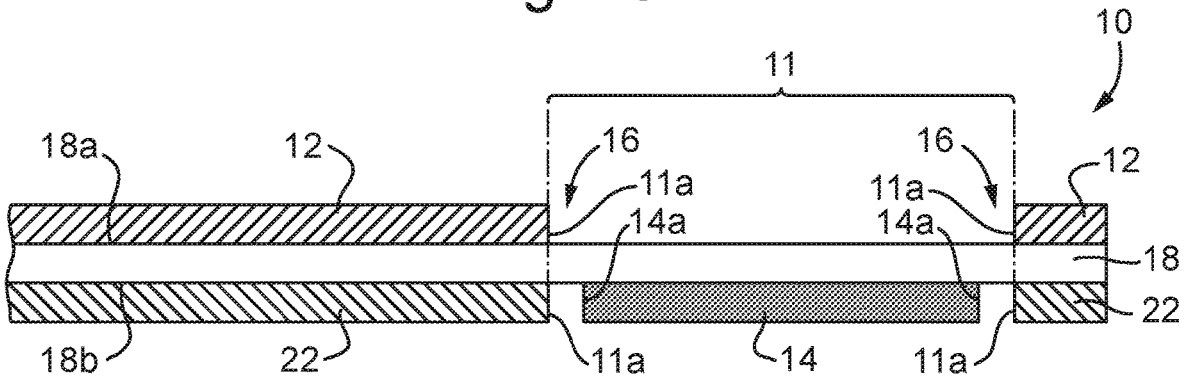

FIG. 2*e* shows a document 10 in which a first background print 12 is provided to a first side 18*a* of the substrate 18 and a second background print 22 is provided to the second side 18*b* of the substrate 18. A boundary of each of the first and second background prints 12, 22 defines the boundary of the the indicium receiving area 11 (i.e. the boundaries of the background prints 12, 22 are congruent around the boundary of the indicium receiving area 11). Therefore, the boundaries of the first and second background prints 12, 22 together define the boundary 11*a* of an indicium receiving area 11. In some embodiments the first and second background prints 12, 22 may have the same extents, but this is not essential.

An indicium 14 is provided on the second side 18*b* of the substrate 18 such that it is positioned laterally (i.e. in the plane of the document 10) within the indicium receiving area 11. Therefore, the indicium 14 is provided entirely within the indicium receiving area 11, such that the juxtaposition of the first and second background prints 12, 22 defines an unprinted keyline 16 extending between the boundary 14*a* of the indicia 14 and the boundary 11*a* of the indicium receiving area 11.

Where the substrate 18 is substantially transparent across at least the indicium receiving area 11 (as defined by the first and second background prints 12, 22), the indicium 14 will be observed surrounded by an unprinted keyline 16 when viewed from each side 18*a*, 18*b* of the substrate 18. Specifically, from the first side 18*a* of the substrate, the indicium 14 and the first background print 12 will be seen, separated by the visually contrasting unprinted (and thereby substantially transparent) keyline 16. In contrast, from the second side of the substrate 18*b*, the indicium 14 and the second background print 22 will be observed separated by the visually contrasting unprinted (and substantially transparent) keyline 16.

Alternatively, if the substrate 18 is formed of a substantially opaque material (e.g. paper) or coated with one or more opacifying layers (not shown) such that it is substantially opaque, the indicium 14 will not be visible from the first side 18*a* of the substrate 18 in reflection.

In this case, from the second side 18*b* of the substrate 18, the indicium 14 will be seen surrounded by a keyline 16 which exhibits the appearance of the unprinted substrate 18 (including any layers applied to the surface of the substrate 18) against the second background print 22. In contrast, from the first side 18*a* of the substrate 18 in reflection the first background print 22 will be observed with an unprinted indicium receiving area 11 defined therein.

During manufacture of the document 10 of FIG. 2*e* the first background print may be applied to the first side 18*a* of the substrate 18 as a first print working, whereas the indicium 14 and the second background print 22 may be applied to the second side 18*b* of the substrate 18 together in a second print working.

Figure 2F:
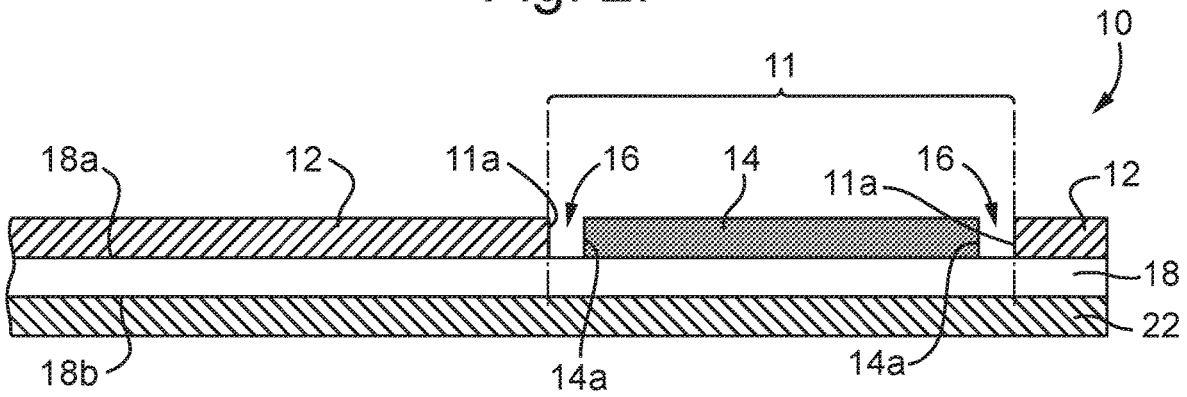

FIG. 2*f* shows a document 10 with two background prints 12, 22 where only the first background print 12 defines the boundary 11*a* of a indicium receiving area 11. Specifically, the boundary of the first background print 12 defines the boundary 11*a* of the indicium receiving area 11. In contrast, the second background print 22 extends continuously across the second side 18*b* of the substrate 18 without interruption. The indicium 14 is provided on the first side 18*a* of the substrate 18 within the indicium receiving area 11, as defined by the first background print 12.

When viewing the document 10 from the first side 18*a* of the substrate 18, the indicium 14 and the first background print 12 are observed separated by a keyline 16 (which, as shown in FIGS. 1*a*, 1*b* and 1*c*, follows the contours of the indicium 14). The appearance of the keyline 16 will vary depending on the opacity of the substrate 18. If the substrate 18 is transparent or translucent a viewer may observe the second background print 22 in the keyline 16 through the substrate 18. This effect will be particularly strong when viewing the document 10 in transmission. Alternatively, if the substrate 18 is substantially opaque an observer will see the substrate 18 in the keyline 16.

If the substrate 18 and second background print 22 are substantially opaque in combination the indicium 14 will not be visible from the second side 18*b* of the substrate. Otherwise the indicium 14 may be observed through the substrate 18 and second background print 22 from the second side 18*b* of the substrate.

Figure 2G:
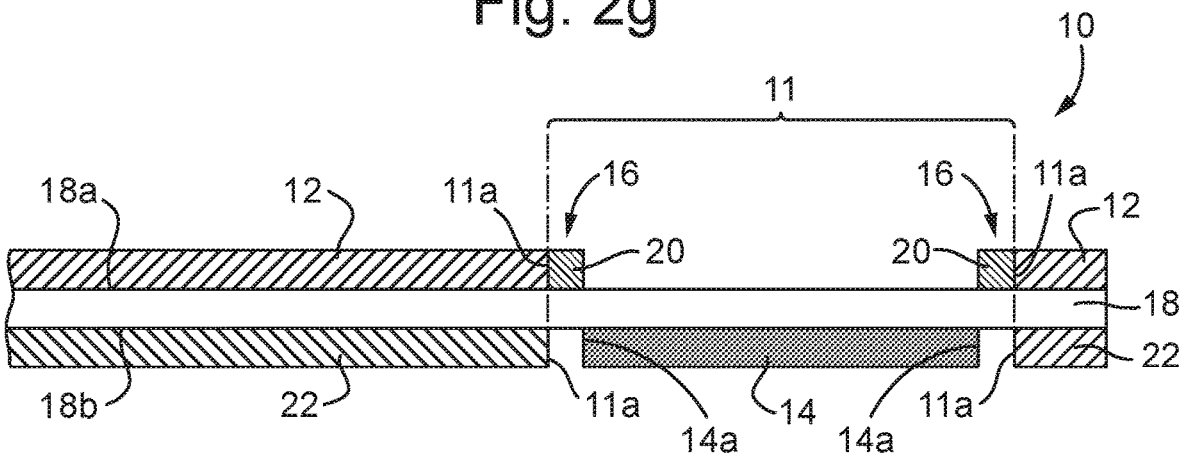

FIG. 2*g* shows a modification of the document 10 shown in FIG. 2*e* wherein the keyline 16 is printed on the first side 18*a* of the substrate 18.

On the first side 18*a* of the substrate 18 there is provided a first background print 12 and an indicium receiving print 20 in a indicium receiving area 11 defined by the first background print 12. The indicium 14 is provided laterally within the indicium receiving area 11 on the second side 18*b* of the substrate 18. The indicium receiving area is otherwise unprinted on the second side 18*b* of the substrate 18. However, in contrast to FIG. 2*e*, the document 10 of FIG. 2*f* further comprises an indicium receiving print 20 applied to the first side 18*a* of the substrate 18 between the boundary 11*a* of the indicium receiving area 11 and the boundary 14*a* of the indicium 14.

Assuming the substrate 18 is substantially transparent, the document 10 shown in FIG. 2*g* will exhibit a similar appearance to the document 10 of FIG. 2*b* when viewed from the first side 18*a* of the substrate 18. Specifically the document 10 exhibits an indicium 14 surrounded by a printed keyline 16 (which exhibits the appearance of indicium receiving print 20) and seen against the first background print 12. In contrast, from the second side 18*b* of the substrate 18 (i.e. the reverse side) the indicium 14 will be seen surrounded by the printed keyline 16 against the second background print 22.

Therefore, the document 10 may exhibit different appearances from either side 18*a*, 18*b* of the substrate 18. The appearance of the two sides may therefore be decoupled assuming that the background prints 12, 22 are substantially opaque. On the other hand, if the first background print 12 and second background print 22 are at least semi-transparent the background prints 12, 22 may be seen superimposed upon one another in transmission from either side 18*a*, 18*b* of the substrate 18.

This example is very difficult to counterfeit because of the need to accurately register the indicium 14 within the lateral area defined within the indicium receiving print 20 on the opposing side of the substrate 18.

Figure 2H:
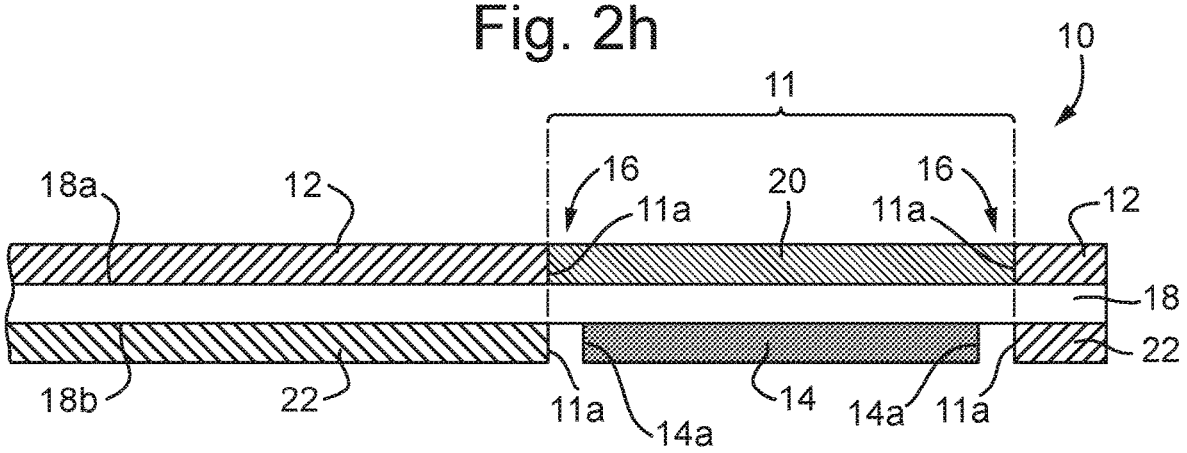

FIG. 2*h* is a further modification of the structure shown in FIG. 2*e*. However, in this case the document 10 of FIG. 2*h* exhibits a similar appearance as the document 10 of FIG. 2*c*.

The extents and positions of the indicia 14, first background print 12 and the second background print 22 are identical to those in FIGS. 2*e* and 2*g*. The document 10 further comprises an additional print 20 provided on the first side 18*a* of the substrate (as in FIG. 2*g*) within the indicium receiving area 11. The additional print 20 extends fully and continuously across the indicium receiving area 11 (the boundary 11*a* of which is defined by the background prints 12, 22).

From the first side 18*a* of the substrate 18, the indicium 14 may be observed through the additional print 20 within the indicium receiving area 11 if the additional print 20 and the substrate 18 in the region of the indicium receiving area 11 are at least semi-transparent in combination. In this situation the indicium 14 will be observed through the indicium receiving print 20 such that they appear superimposed. In addition, the indicium 14 and will be separated from the first background print 12 by a printed keyline 16 which exhibits the appearance of the print 20 and is laterally positioned between the indicium 14 and the first background print 12. Where the print 20 within the indicium receiving area 11 and the substrate 18 are substantially opaque in combination the indicium 14 will not be observed from the first side 18*a* of the substrate 18.

Regardless of the opacity of the indicium receiving print 20 and the substrate 18, from the second side 18*b* of the substrate 18 the document 10 of FIG. 2*h* will exhibit a similar appearance as the document 10 of FIG. 2*g*—the indicium 14 and the second background print 22 will be observed separated by a keyline 16 which surrounds the indicium 14 and exhibits the appearance of the print 20 within the indicium receiving area 11.

FIGS. 2*i* to 2*l* show further examples of documents 10 which exhibit indicia 14 surrounded by keylines 16. However, in each case the indicia 14 is split into two parts 14*b*, 14*c*. The first part 14*b* of the indicium 14 is provided to the first side 18*a* of the substrate 18, whilst the second part 14*c* of the indicium 14 is provided to the second side 18*b* of the substrate 18.

In each case the substrate 18 is substantially visually transparent across at least the indicium receiving area 11, and as such the two parts 14*b* and 14*c* may be seen in combination from either side of the document 10 in transmission. Therefore, as will be appreciated the documents 10 of FIGS. 2*i* and 2*j* will appear similar to the documents 10 shown in FIGS. 2*a* and 2*e* respectively when viewed in transmission and the documents 10 of FIGS. 2*k* and 2*l* will appear similar to the documents 10 shown in FIGS. 2*b* and 2*g* respectively when viewed in transmission (assuming the documents 10 of FIGS. 2*a*, 2*e*, 2*b* and 2*g* have substantially transparent substrates).

However, the documents 10 of FIGS. 2*i*, 2*j*, 2*k* and 2*l* may exhibit different appearances to documents 2*a*, 2*e*, 2*b* and 2*g* respectively when viewed in reflection, since only the part 14*b*, 14*c* of the indicium 14 applied to the respective side 18*a*, 18*b* of the substrate 18 may be observed (depending on the reflectivity of the substrate 18).

Figure 2I:
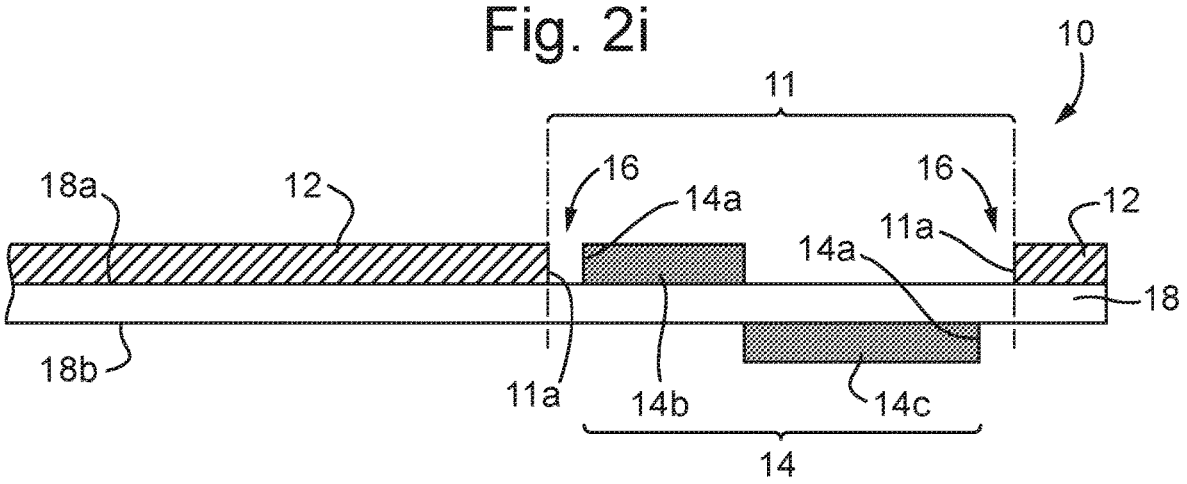
Figure 2J:
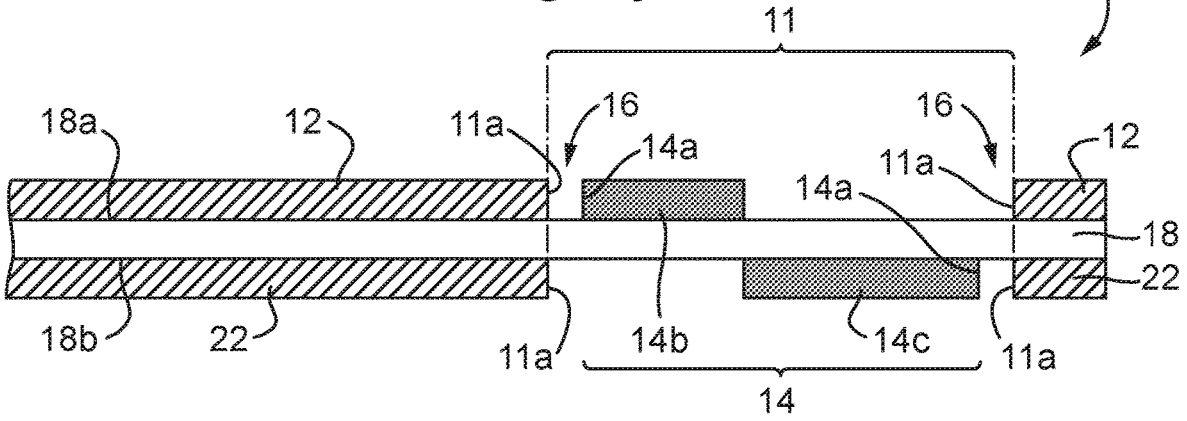
Figure 2K:
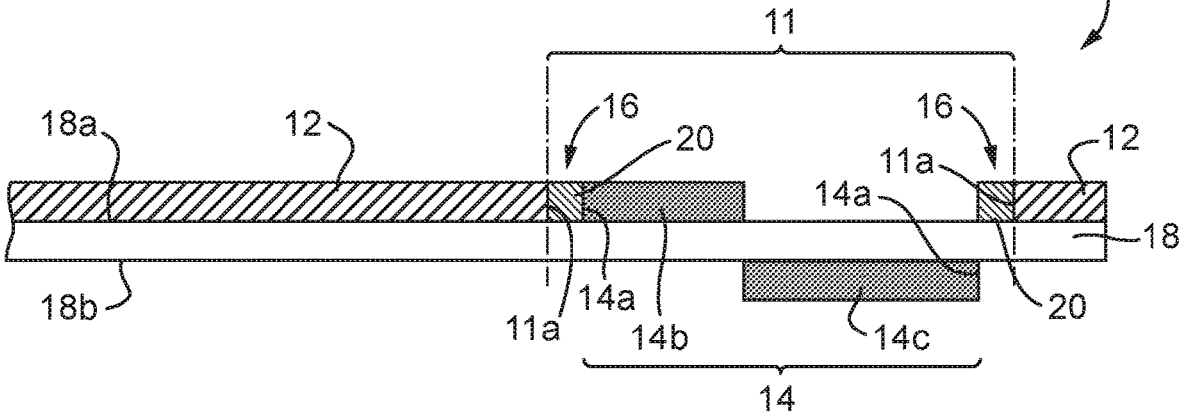
Figure 2L:
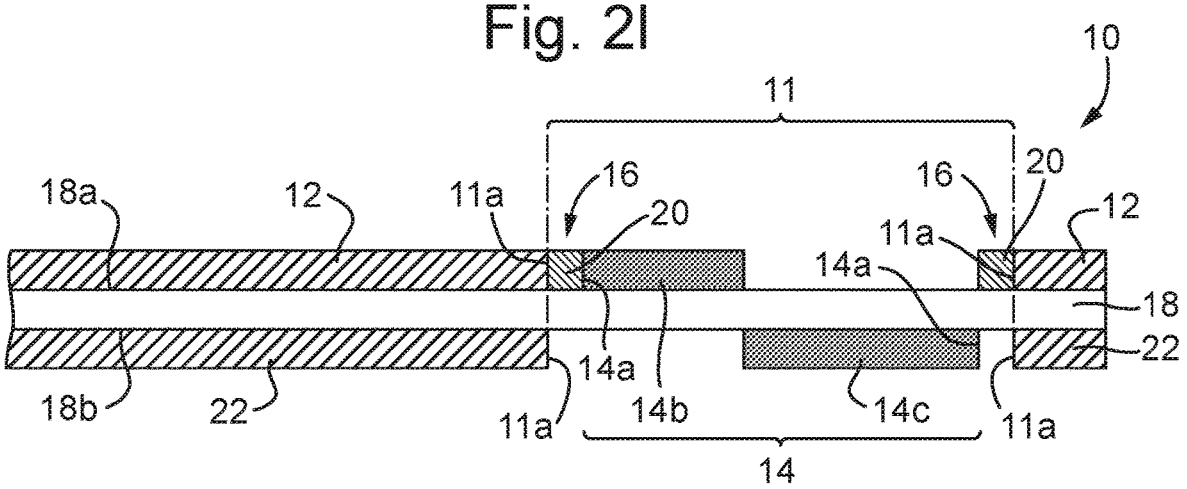

In FIGS. 2*i* and 2*j* the keyline 16 is unprinted and substantially transparent. In FIGS. 2*k* and 2*l* the documents 10 are provided with an indicium receiving print 20 which extends between the boundary 14*a* of the indicium 14 and the boundary 11*a* of the indicium receiving area 11. In this case the keyline 16 therefore exhibits the appearance of the indicium receiving print 20 and may be either transparent or opaque depending on the properties of the indicium receiving print 20.

The documents 10 of FIGS. 2*i*, 2*j*, 2*h* and 2*l* are significantly more difficult for an unauthorised reproducer to copy than the documents 10 of FIGS. 2*a* and 2*e* since it is very difficult to accurately register the different parts 14*b*, 14*c* of the indicium 14 together since they are provided to opposing sides of the substrate 18 (i.e. they are applied in separate print workings). Therefore, these documents 10 offer increased security.

Any of the documents 10 discussed above with reference to FIGS. 2*a* to 2*l* may comprise a plurality of further workings or layers extending across whole or part of the document 10, and on either or both sides 18*a*, 18*b* of the substrate 18. These may include additional print workings, opacifying layers protective layers, adhesive layers or antistatic conductive layers. These workings and layers may be provided within the substrate 18, or be applied or printed on the substrate 18 such that they overlie or underlie one or more of the background prints 12, 22, indicium 14 and printed keyline regions 20 relative to the substrate 18.

In summary, it will be appreciated that documents 10 with identifiers in which the indicia 14 of an identifier are wholly surrounded by a keyline 16 offers increased security. However, this is not essential and in further documents a keyline may be provided which only extends around a portion of an indicium. Examples of such documents are shown in FIGS. 3, 4 and 5.

Figure 3:
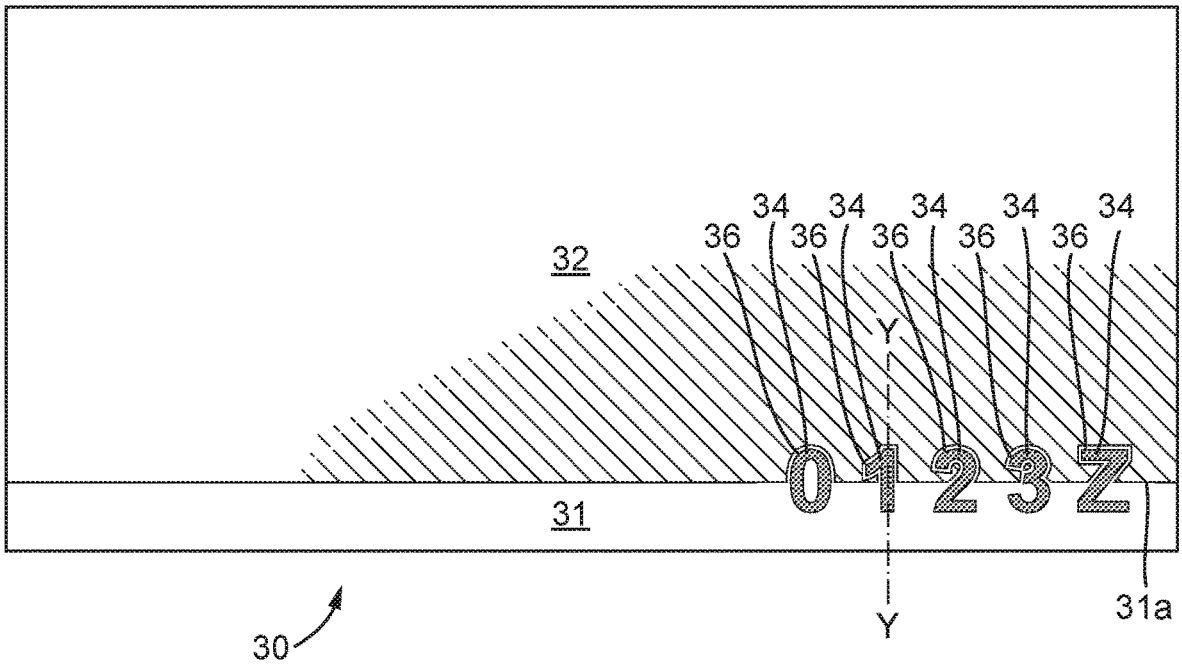
FIG. 3 shows a diagrammatic representation of a face of a further document in accordance with the present invention in which only a unique identifier, background print and keylines are illustrated.

FIG. 3 shows a face of a document 30 in accordance with the present invention provided with a background print 32 and an identifier. In line with FIG. 1 the identifier comprises five laterally spaced indicia 34. These indicia 34 are again alphanumeric and read "01231". As shown, the upper portion of each indicium 34—approximately half of each indicium 34—is surrounded by a keyline 26.

Unlike in FIG. 1 the first background print 32 of the document 30 in FIG. 3 does not define a corresponding number of indicium receiving areas, such that each indicium 34 is provided in a respective indicium receiving area. Rather, the background print 32 defines the boundary 31*a* of a single indicium receiving area 31 in which all of the indicia are provided. As shown, the indicium receiving area 31 extends across the entire width of the document 30 and the indicia 14 are provided fully within the indicium receiving region 31. As will be seen from the figure, the indicium receiving area 31 extends between a boundary 31*a* defined by the first background print 32 and the external boundary or extreme extents of the document 30.

The part of the boundary 31*a* of the indicium receiving area 31 defined by the first background print 32 extends around the top or upper portion (approximately the top half) of the boundary 34*a* of each indicium 34. Therefore, a keyline 36 which extends around the upper portion of the boundary of each indicium 34 and the boundary 31*a* of the indicium receiving area 31 is formed by the juxtaposition of the first background print 32 and the indicium 34.

The boundary 31*a* of the indicium receiving area 31 defined by the first background print 32 is approximately parallel to the boundary of the indicia 34. Therefore, the keylines 36 are of substantially the same width at all points around the upper portion of each indicium 34. In addition the width of the keylines 36 is substantially the same width around all of the indicia 34. This appearance requires highly accurate registration (i.e. relative positioning) between the background pint 32, indicia 34 and the indicium receiving area 31.

Approximately half of each indicium 34 is surrounded by a keyline 36—i.e. a keyline 36 extends around approximately 50% of the boundary of each indicium 34 by length (although the specific figure will vary dependent on the shape and distribution of each indicium 34).

The details of the appearance of the background print 32 are not shown in FIG. 3. However, substantially any image, symbols, text or graphics may be provided as part of the background print 32 to enable the document 10 to perform its function.

As discussed with reference to FIG. 1, as the unique identifier is varied between documents 30 in the series, the indicia 34 forming the identifier will change and therefore the boundaries 34*a* of the indicia 34 will also change between documents 30. Hence, in order to correctly generate keylines 36 surrounding the indicia 34 as shown in FIG. 3, the indicia 34 and the background pint 32 (which defines the indicium receiving area 31) must be varied between documents 30 to achieve the keylines. This variation is not easy for an unauthorised reproducer to achieve using conventional printing technologies for producing large numbers of uniquely identified documents.

Exemplary cross sections of a document 30 along line Y-Y which may be used to produce this appearance will be discussed below in reference to FIGS. 4*a* to 4*e*.

In each cross section the indicium 34 (the figure "1", as shown in FIG. 3), the first background print 32, the indicium receiving area 31 and keyline 36 (as defined by the juxtaposition of the indicium 34 and the first background print 32) have the same extents in the plane of the document 30 (i.e. the same lateral extents).

Figure 4A:
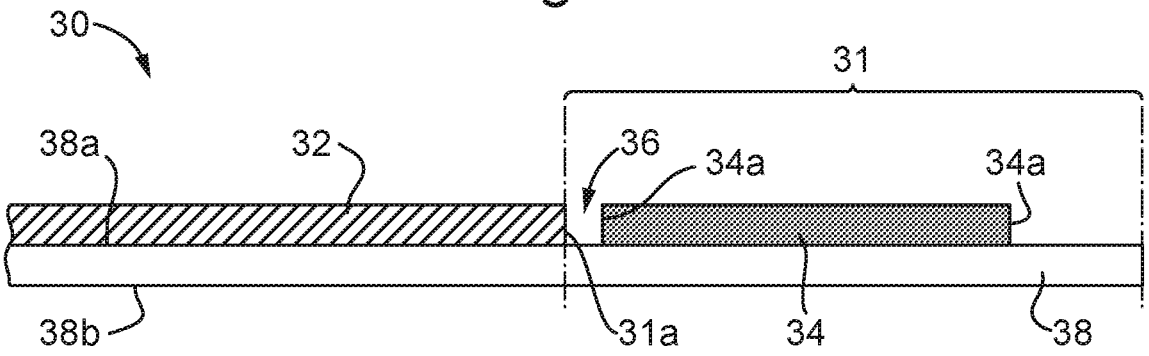
FIGS. 4*a* to 4*e* show alternative cross sections in accordance with the present invention through the document shown in FIG. 3 along line Y-Y.
Figure 5:
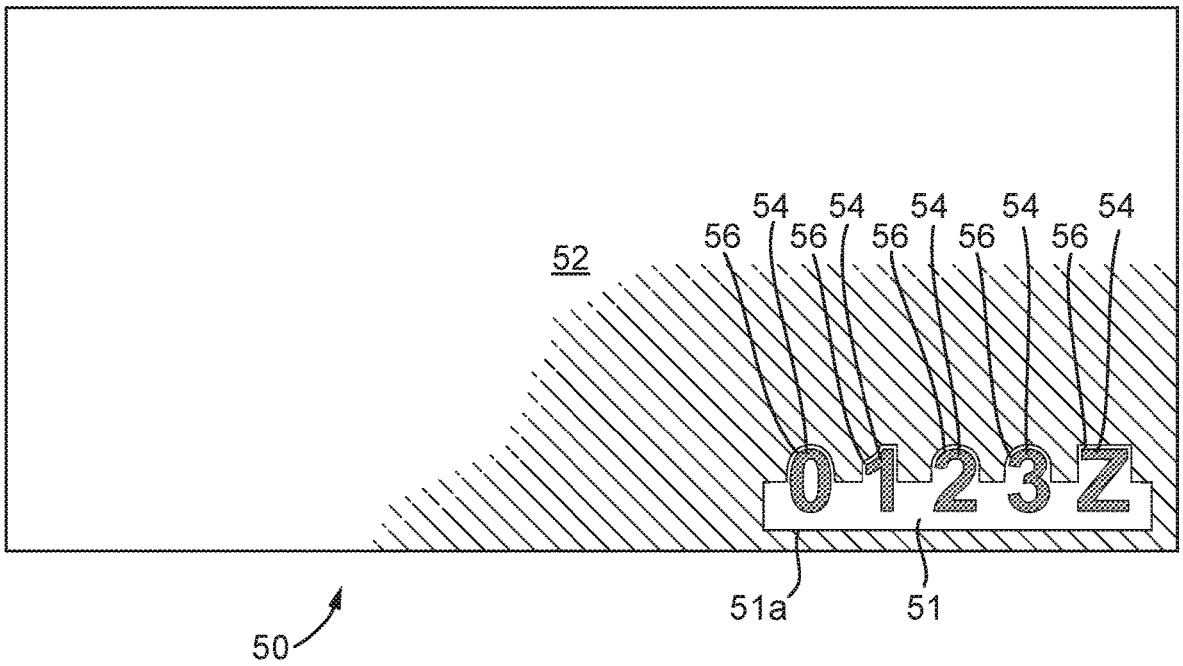
FIG. 5 shows a diagrammatic representation of a face of a further document in accordance with the present invention in which only a unique identifier, background print and keylines are illustrated.

The document 30 of FIG. 4*a* broadly corresponds in structure and manufacturing methods to the document 10 of FIG. 2*a*. The first background print 32 and the indicium 34 are provided on the first side 38*a* of a substrate 38. As shown, the portion of the indicium receiving area 31 which separates the first background print 32 and the indicium 34 is unprinted on both sides 18*a*, 18*b* of the substrate 18, and part of the boundary 31*a* of the indicium receiving area 31 is defined by (and therefore coincident with) the boundary of the first background print 32. The remaining boundary of the indicium receiving area 31 is defined by the boundary or outer extent of the document 30. The indicium 34 is provided within the indicium receiving area 31 such that a keyline 36 is defined between the boundary 34*a* of the indicium 34 and the boundary 31*a* of the indicium receiving area 31 (as defined by the first background print 32). The background print 32*b* and the indicium 14 may be applied in separate print workings, in a single print working or in any other suitable method.

Figure 4B:
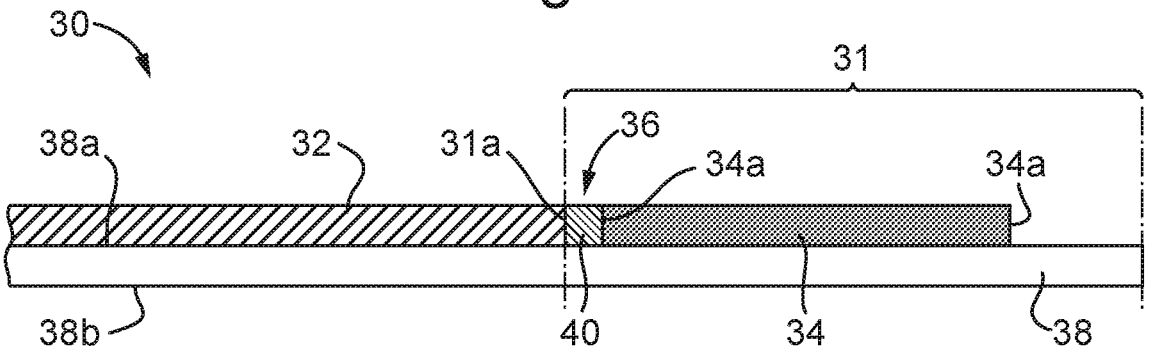

FIG. 4*b* shows an alternative structure for a document 30 with the appearance of FIG. 3 in cross section along line Y-Y. This document 30 and shares a similar structure to the document 10 shown in FIG. 2*b*. In addition to the features of the document 30 shown in FIG. 4*a*, this document 30 further comprises an indicium receiving print 40 (not shown in FIG. 3) which is provided between the upper portion of the boundary 34*a* of the indicium and the boundary 31*a* of the indicium receiving area 31 such that the indicium receiving print 40 fills and extends across the keyline 36.

Therefore when the document 30 is observed the differences in properties of the first background print 32, the indicium 34, the keyline 36 and the indicium receiving print 40 which extend around the upper portion of the indicium 34 and the unprinted substrate 38 which surrounds the bottom portion of the indicium 34 may be compared. Reproducing the appearance of each of these regions and printed features is not easy for a would-be counterfeiter, and any unexpected variations in appearance (e.g. colour, tint, transparency, reflectivity, pattern, texture and/or another observable property) may be easily identified by an authenticator. Therefore the security of the document 30 is increased.

Figure 4C:
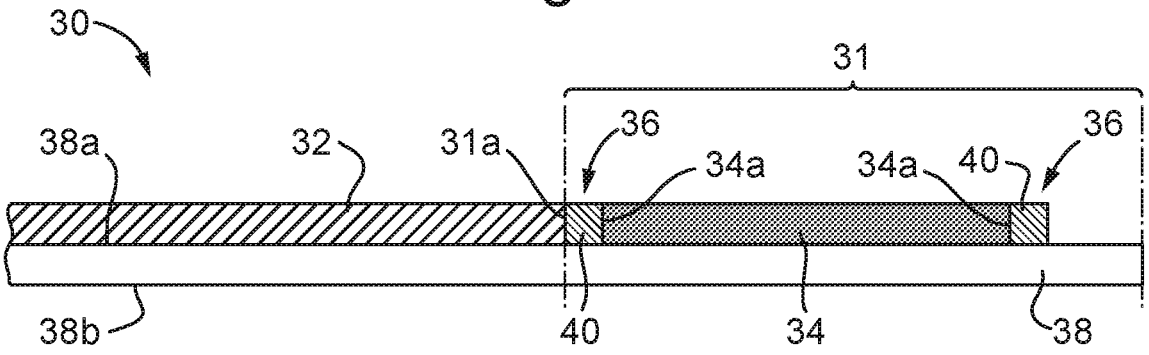

FIG. 4*c* shows a modification of the structure shown in FIG. 4*b* wherein the indicium receiving print 40 (not shown in FIG. 3) extends around the entire boundary 34*a* of the indicia 34 with substantially the same width at each point around the boundary 34*a* of the indicia 34.

Therefore, as will be appreciated a printed keyline 36 with the appearance of the indicium receiving print 40 extends around the entirety of the boundary 34*a* of the indicia 34. The keyline 36 defined between the boundary 34*a* of the indicia 34 and the external boundary of the indicium receiving print 40. Around the upper portion of the indicia, the external boundary of the indicium receiving print 40 is coincident with the part of the boundary 31*a* of the indicium receiving area 31 defined by the first background print 32.

Again, when the document 30 is observed, differences in properties and appearances of the first background print 32, indicium 34, and the indicium receiving print 40 and the unprinted substrate 38 within the indicium receiving area 31 may be easily compared. Since the indicium receiving print 40 extends around the entirety of the indicium 34 it is more difficult to register the indicium 34 and the printed keyline region 40 relative to one another. Therefore the security of the document 30 is increased relative to conventional documents distinguished using identifiers as the document 30 is more difficult for a would-be counterfeiter to imitate.

Figure 4D:
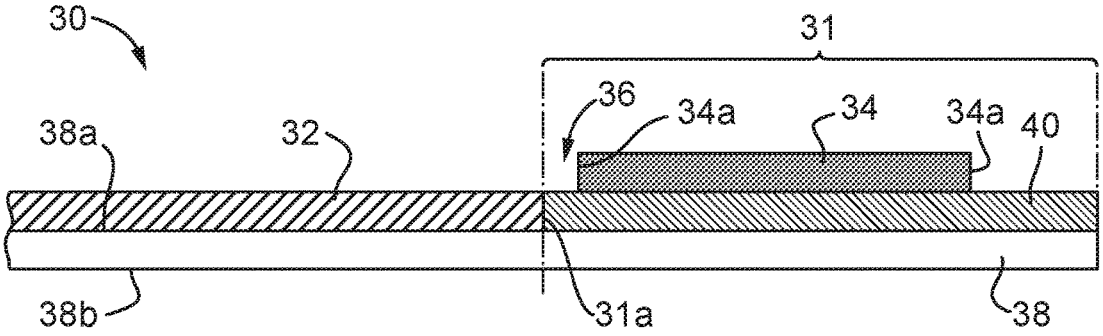

FIG. 4*d* shows a document 30 where a continuous printed layer comprising a first background print 32 and an indicium receiving print 40 is provided across the entirety of the first surface 38*a* of a substrate 38. The boundary between the first background print 32 and the indicium receiving print 40 defines part of the boundary 31*a* of an indicium receiving area 31 (i.e. the first background print 32 defines part of the boundary 31*a* of the indicium receiving area 31). This boundary 31*a* may be defined by any variation in the properties of the background print 32 and the indicium receiving print 40. For instance, the first background print 32 and the indicium receiving print 40 may exhibit different appearances and exhibit different colours or tints, patterns, textures or any other suitable property. The indicium 34 is provided in the indicium receiving area 31, in contact with and over the indicium receiving print 40 relative to the first side 38*a* of the substrate.

The first background print 32 and the indicium receiving print 40 are preferably applied as a single print working, and the indicia 34 is overprinted in a subsequent print working. However, this is not essential.

Assuming the substrate 38 and the indicium receiving print 40 are at least semi-transparent in combination, when the document 30 is viewed from the first side 38*a* of the substrate 38 the indicia will be observed surrounded by the indicium receiving print 40, whereas when the document 30 is viewed from the second side 38*b* of the substrate 38 the indicium 34 will be viewed in transmission through the an indicium receiving print 40 (such that the indicium 34 and the indicium receiving print 40 appear superimposed). In contrast, if the substrate 38 and the indicium receiving print 40 are substantially opaque the indicium 34 will only be seen from the first side 38*a* of the substrate 38 surrounded by the indicium receiving print 40. In each case the indicium 34 will be seen partially surrounded by a keyline 36 formed by the indicium receiving print 40 extending around an upper portion of the indicium 34 between the boundary 31*a* of the indicium receiving area 31 and the boundary 34*a* of the indicium 34.

Figure 4E:
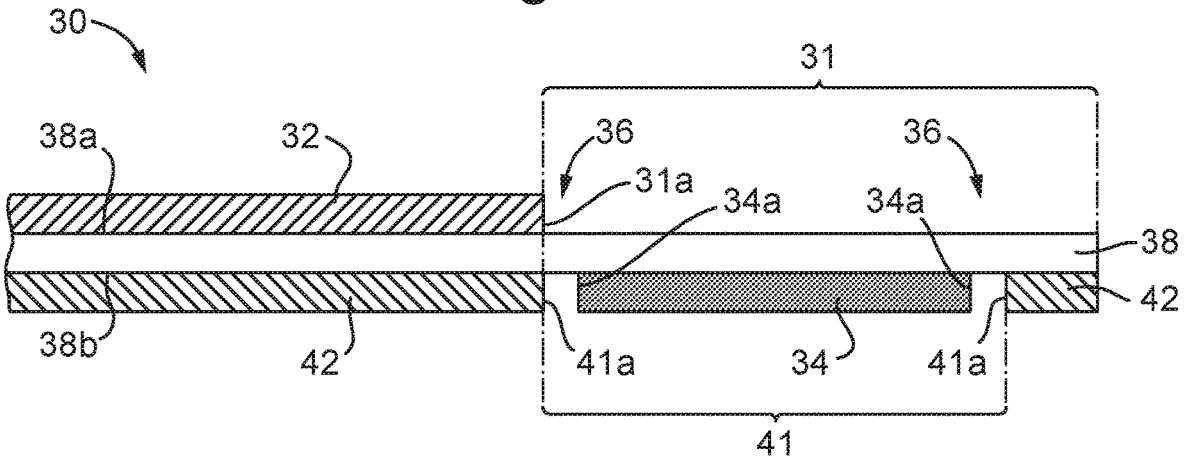

FIG. 4*e* shows a document 30 which exhibits an alternative "double-sided" appearance, wherein the appearance of the document 30 is different when viewed from the first side 38*a* of the substrate 38 and the second side 38*b* of the substrate 38. As will be seen, the document 30 shown in FIG. 4*e* is analogous to the document 10 of FIG. 2*e*.

In FIG. 4*e* the document 30 is provided with a first background print 32 on a first side 38*a* of an at least semi-transparent substrate 38. The boundary of the first background print 32 defines part of the boundary 31*a* of a first indicium receiving area 31 with the same extent as the indicium receiving areas discussed above with reference to FIG. 3 and FIGS. 4*a* to 4*d*. Specifically, the first indicium receiving area extends between a boundary 31*a* defined by the first background print and the external boundary 30*a* of the document 30 itself.

The first indicium receiving area 31 is unprinted on the first side 38*a* of the substrate 38.

On the second side 38*b* of the substrate 38 are provided a second background print 42 and the indicium 34. The boundary of the second background print 42 wholly defines the boundary 41*a* of second indicium receiving area 41. As will be seen the second indicium receiving area 41 extends over a part of the lateral extent of the first indicium receiving area 31.

The indicium 34 is arranged laterally such that it is provided in both the first indicium receiving area 31 and second indicium receiving area 41. A keyline 36 is defined between the boundary 31*a* of the first indicium receiving area 31 and the boundary 34*a* of the indicium 34 and extends around the upper portion of the indicium 34 (as shown in FIG. 3). A further keyline 36 (not shown in FIG. 3) is defined between the boundary 41*a* of the second indicium receiving area 41 and the boundary 34*a* of the indicium 34 and extends around the whole boundary of the indicium 34.

When viewed from the second side 38*a* of the substrate 38 the document 30 will exhibit the same appearance to an observer as the document 10 of FIG. 2*e*—an indicium 34 printed against a second background print 42 such that the indicium 34 and second background print 42 separated by an unprinted keyline 46. This is because the boundary 31*a* of the first indicium receiving area 31 and the boundary 41*a* of the second indicium receiving area 41 are coincident around the upper portion of the indicium 34 (shown to the left of FIG. 4*e*) such that the keyline 36 appears continuous around the whole of the boundary 34*a* of the indicium 34.

However, assuming the substrate 38 is at least semi-transparent the document 30 will provide a different appearance from the first side 38*a* of the substrate. Specifically, when viewed from the first side 38*a* of the substrate 38 the document 30 will exhibit an indicium 34 entirely surrounded by an unprinted keyline 36. The keyline 36 will separate the upper portion of the indicia 34 from the first background print 32 (as shown in FIG. 3), and the lower portion of the indicia 34 from the second background print 42 (not shown in FIG. 3).

Therefore, the appearance of the document 30 will be different when viewed from either side 38*a*, 38*b* of the substrate 38 (i.e. from either side of the document 30 in use). In this case an observer will be able to inspect the document 30 in order to compare the properties and appearances of each of the printed and unprinted features from either side.

The documents 30 shown in FIGS. 4*a* to 4*e* may be further modified to create more complicated visual effects using any of the structures and techniques discussed with reference to FIGS. 1 and 2*a* to 2*l*. For instance, the indicia 34 may be split into two parts which are printed on opposing sides of the documents 30, as in FIGS. 2*i* to 2*l*. Alternatively, one or more indicium receiving prints may be provided under or around the indicium 34 in (for instance) FIG. 4*e* such that these prints appear in the keyline 36 extending around at least part of the indicium 34.

FIG. 5 illustrates a further exemplary document 50 that comprises many similar features to the documents 10, 30 of FIGS. 1 and 3. This document 50 may be constructed using any of the techniques discussed above. As seen from the figure, the document 50 is provided with an identifier comprising five alphanumeric indicia 54 reading "0123Z"

As with the document 30 of FIG. 3, the document 50 of FIG. 5 comprises a background print 52 which here defines the whole of the boundary of an indicium receiving area 51. The indicia 54 are provided within the indicium receiving area 51 such that they are surrounded in a lateral direction (i.e. in the plane of the document 50) by the boundary of the indicium receiving area 51.

However, the document 50 of FIG. 5 differs from the documents 10, 30 of FIGS. 1*a* and 3 in two significant aspects.

Firstly, the keyline 56 generated by the juxtaposition of the background print 52 and indicia 54 only extends around a portion of the indicia 54 (unlike in the document 10 shown in FIGS. 1*a*, 1*b* and 1*c*). As in the embodiments discussed above, a keyline 56 is defined between the boundary of the indicium receiving area 51 (as defined by the background print 52) and the boundary of each indicium 54 rather than approximately the upper half of each indicium 54 as shown in FIG. 3. However, the boundary of the indicium receiving area 51 only follows a contour of the boundary of each indicium 54 at an uppermost portion of the indicia 54. For instance, it will be seen that the keyline 56 which extends around the indicium "Z" only extends as a border around the top and sides of the upper bar (i.e. upper horizontal stroke) of the letter "Z".

The proportion of each indicium 54 where a keyline 56 extends adjacent to the boundary of the indicia 54 varies dependent on the shape of the indicia 54. In the case of the "2", "3", and "Z" indicia 54 a keyline 56 extends around approximately 20% of the boundary of each indicium 54 by length. In the case of the indicium "1" a keyline 56 extends around approximately 40% of the indicium 54. A keyline 56 extends around approximately 50% of the external boundary of the indicium "0". No keyline 56 extends around the internal boundary of the "0" (i.e. around the boundary of the negative space within the "0).

Secondly, the lateral extent of the indicium receiving area 51 shown in FIG. 5 is reduced in size relative to the document 30 of FIG. 3. Instead of extending across the entire width of the document 50, the indicium receiving area 51 of FIG. 5 covers less than 10% of the area of the document 50. Unlike the document 30 of FIG. 3, the indicium receiving area 51 shown in FIG. 5 does not extend to the boundaries of the document 50. In other words, the boundary of the indicium receiving areas 51 is wholly defined by the background print 52. As discussed with reference to FIGS. 4*a* to 4*e* the indicium receiving area 51 may be printed or unprinted.

It will be appreciated that the additional features of the indicium receiving area 51 discussed with reference to FIG. 5 are not intrinsically related to each other and may be combined in with the features of the alternative embodiments of documents discussed above in any combination.

Furthermore, it will be appreciated that the different structures shown in the exemplary cross sections of FIGS. 2*a* to 2*l* and FIGS. 4*a* to 4*e* (or any modifications of the structures) may be used to create keylines around different indicia provided in the same identifier or indicia provided to the same document. For instance, where an identifier comprises two or more indicia, one or more indicia may be surrounded by a keyline formed using the structure shown in FIG. 2*a*, whilst one or more one or more indicia of the same identifier may be provided according to the cross section of FIG. 4*b*, and so one.

FIGS. 6, 7, 8, and 9 show portions of further documents 60, 70, 80, 90 to which an identifier 69, 79, 89, 99 has been applied. The documents 60, 70, 80, 90 are part of a wider series of documents each provided with a unique identifier 69, 79, 89, 99.

These documents 60, 70, 80, 90 illustrate that a wide variety of identifiers 69, 79, 89, 99 may be used with the present invention. In FIG. 6 an alphanumeric serial code 69 is printed vertically and horizontally on the document 60. The serial code reads "A/I 000000". In addition each indicium 64 in the identifier 69 is increased in size relative to the preceding indicia 64. In FIG. 7 the identifier 79 is a circular code. In this code a string or series of digits are represented by the arcs in a series of segments surrounding a circle at the centre of the identifier 79 (marked 'AC'). The value of each digit in the string is encoded by the number of arcs in the corresponding segment and the distance of the arcs from the centre of the identifier 79. FIG. 8 shows an identifier 89 (specifically an alphanumeric code reading "A1234556789A") using a conventional typeface where the code is arranged in a circular pattern. FIG. 9 shows an identifier 99 which again reads "A/I 000000" and has the same increase in size between indicia 94 as in the horizontal identifier 69 of FIG. 6.

The documents 60, 70, 80, 90 are each constructed using two print workings 61, 71, 81, 91 and 65, 75, 85, 95 (95 not shown) which are applied to opposing sides of a substantially transparent substrate. The documents 60, 70 shown in FIGS. 6 and 7 are similar in arrangement and structure to the cross section of a document 10 shown in FIG. 2*g*. The document 80 shown in FIG. 8 is similar in arrangement and structure to the cross section of a document 10 shown in FIG. 2*e*. Finally, the document 90 shown in FIG. 9 is similar in arrangement and structure to the cross section to the document 10 shown in FIG. 2*i*.

Figure 6A:
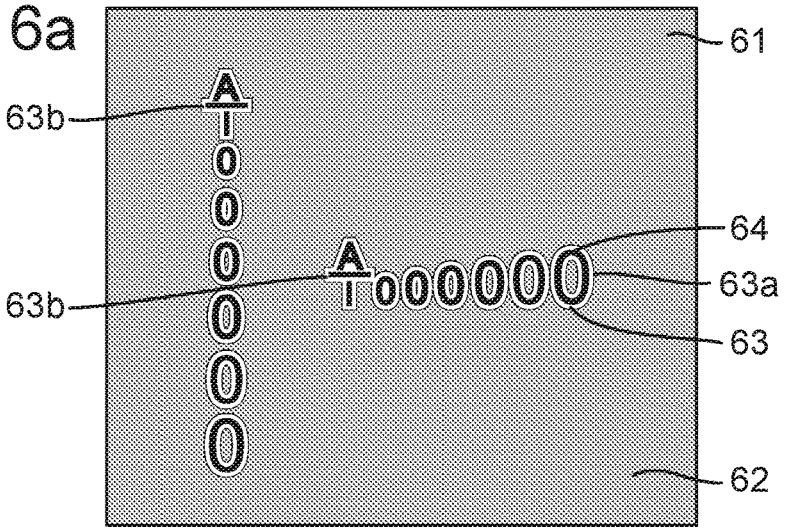
FIG. 6*a* and FIG. 6*b* respectively show a portion of a first print working and a portion of a second print working which may be used to produce a document according to the present invention; a portion of the face of this document as seen in transmission is shown in FIG. 6*c;*
Figure 6B:
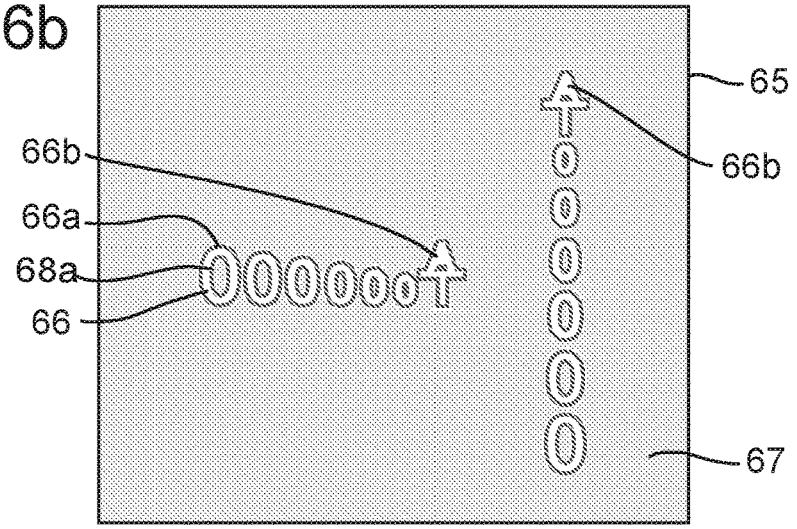
Figure 6C:
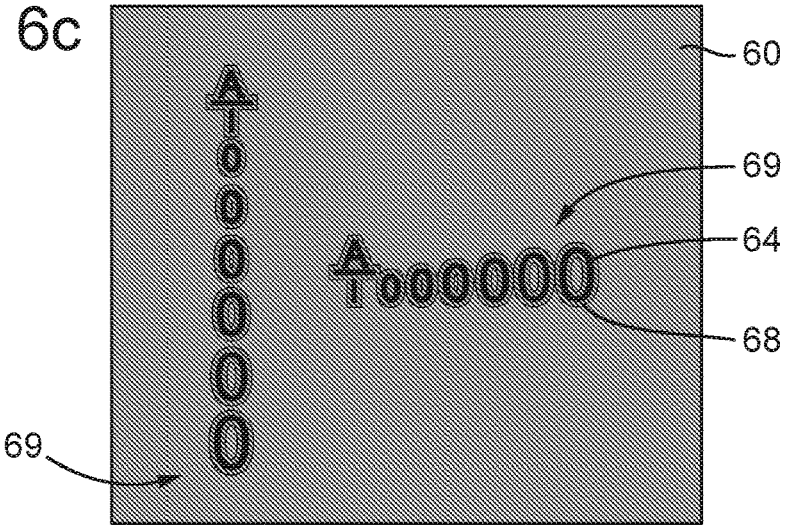

FIG. 6*a* shows a first print working 61 applied to the first side of the substrate of a document 60. FIG. 6*b* shows a second print working 65 applied to the opposing, second side of the substrate of the document 60. Finally, FIG. 6*c* shows the document 60 as seen in transmission from the first side of the substrate.

The first print working 61 of FIG. 6*a* corresponds to the combination of a second background print 22 and indicia 14 of FIG. 2*g*. As will be seen from FIG. 6*a* the first print working 61 comprises a first background print 62, the boundary of which defines the boundaries 63*a* of a plurality of unprinted first indicium receiving areas 63. The first print working further comprises a plurality of indicia 64 which form the identifiers 69 applied to the document 60. Each indicium 64 is located within a respective first indicium receiving area 63, such that the juxtaposition of each indicium 63 and the first background pint 62 defines a keyline 68 which extends around each indicium 63. As mentioned above, the first indicium receiving areas 63—and therefore the keyline 68 formed within the indicium receiving areas 63—are unprinted in the first print working 61.

The second print working 65 corresponds to the combination of the first background print 12 and the indicium receiving print 20 of FIG. 2*g*. As shown in FIG. 6*b* the second print working 65 comprises a second background print 67 which defines the boundaries 66*a* of a plurality of second indicium receiving areas 66. The plurality of second indicium receiving areas 66 share the same lateral extents as the first indicium receiving areas 63. Furthermore, the first and second print workings 61, 65 are applied to the document 60 in register such that the first and second indicium receiving area 63, 66 are congruent. In other words, the first and second indicium receiving areas 63, 66 share the same lateral extents and positioning in document 60, as will be seen in FIG. 6*c*.

The second print working 65 further comprises a plurality of indicium receiving prints 68*a* provided within the plurality of second indicium receiving areas 66 defined by the second background print 67. Each of the indicium receiving prints 68*a* extends between the boundary 66*a* of the respective second indicium receiving area 66 and the boundary of the respective indicium 64 provided laterally within said respective indicium receiving area 66 (but to the opposing first side of the document 60 substrate). Therefore, the indicium receiving prints 68*a* define an internal unprinted region which has the same lateral extent of the respective indicium 64 (as applied to the first side of the substrate of the document 60). The indicium receiving prints 68*a* form a plurality of printed keylines 68 applied to the second side of the substrate of the document 60, and extending in a lateral direction around the boundaries of the indicia 64.

The first background print 62 and second background print 67 are coloured and semi-transparent. Therefore, when viewed from the first side of the document in transmission, as shown in FIG. 6*c*, the indicia 64 is seen surrounded by a keyline 68 which exhibits the appearance of the indicium receiving print 68*a*, and against the superimposed combination of the first background print 62 and second background print 67 (i.e. the indicia 64 are separated from the superimposed first background print 62 and second background print 67 by the keylines 68).

The indicium receiving areas 63*b*, 66*b* in which the indicia "A", "I" and "I" are provided are not separated or laterally spaced. Instead, the background prints 61, 65 provided to the first side of the document 90 defines continuous indicium receiving areas 63*b*, 66*b* in which all three indicia appear when the document 60 is viewed in transmission. In contrast, the indicium receiving areas 63, 66 in which the "0" indicia appear are not continuous and are laterally spaced.

Figure 7A:
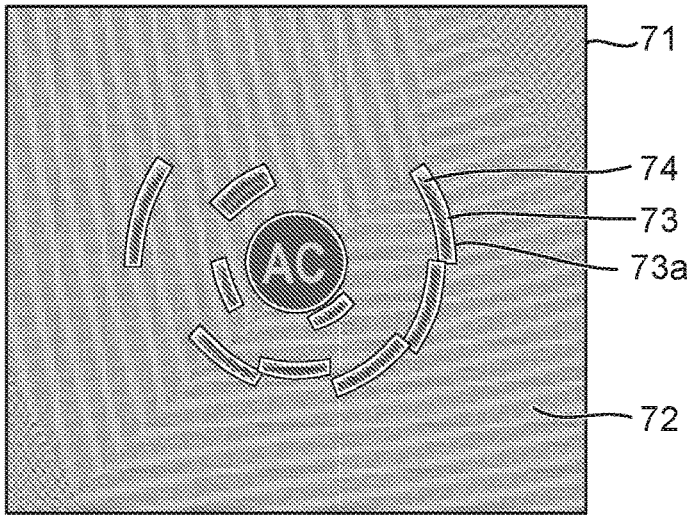
FIG. 7*a* and FIG. 7*b* respectively show a portion of a first print working and a portion of a second print working which may be used to produce a document according to the present invention; a portion of the face of this document as seen in transmission is shown in FIG. 7*c;*
Figure 7B:
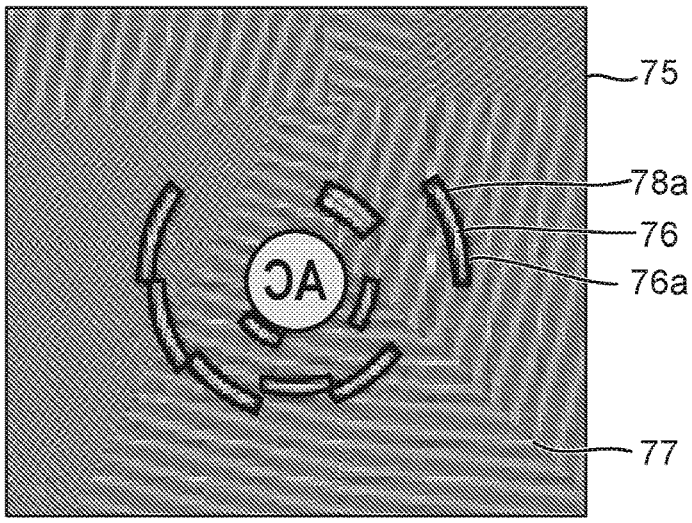
Figure 7C:
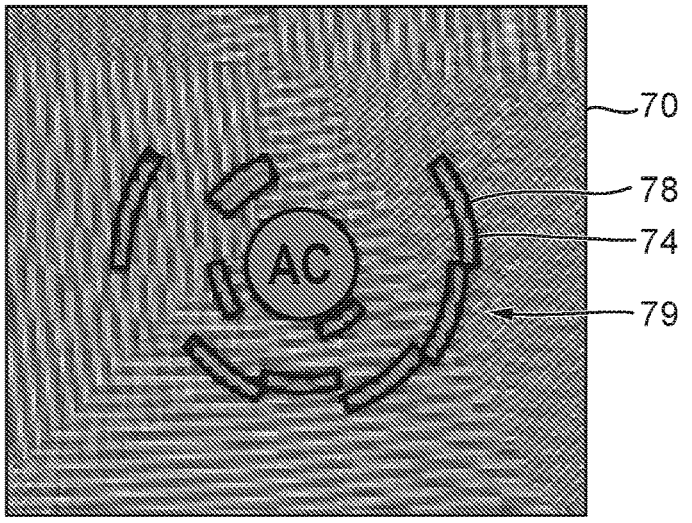

FIGS. 7*a* and 7*b* show the print workings 71, 75 used to form the document 70 shown in FIG. 7*c*. The document 70 and the print workings 71, 75 have a similar structure and features as the document 60 and print workings 61, 65 shown in FIG. 6. However, the reference signs have been incremented by a value of 10 between the corresponding figures. Rather than an alphanumeric indentifier 69 (as shown in FIG. 6), the document 70 shown in FIG. 7 exhibits a symbolic code formed of indicia 73 in the form of curved line elements or glyphs.

Preferably each of the printed features of FIGS. 6 and 7 visually contrast. For instance, in the document 60 of FIG. 6 the first background print 62 may appear pink, the indicium receiving prints 68*a* (and therefore the keylines 68) may appear mauve, the indicia 64 may appear indigo, and the second background print 67 may appear blue. The first background print 62 and the second background print 67 of the document 60 in FIG. 6 exhibit anti-scan line screen patterns. Equally, in FIG. 7 the first background print 72 may be an orange anti-scan pattern, the indicium receiving prints 68*a* may be unpatterned green regions, the indicia 74 may be unpatterned orange regions, and the second background print 77 may be a green anti-scan pattern.

Figure 8A:
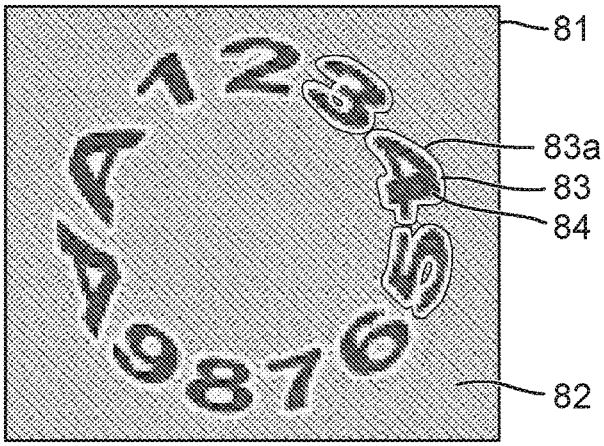
FIG. 8*a* and FIG. 8*b* respectively show a portion of a first print working and a portion of a second print working which may be used to produce a document according to the present invention; a portion of the face of this document as seen in transmission is shown in FIG. 8*c;*
Figure 8B:
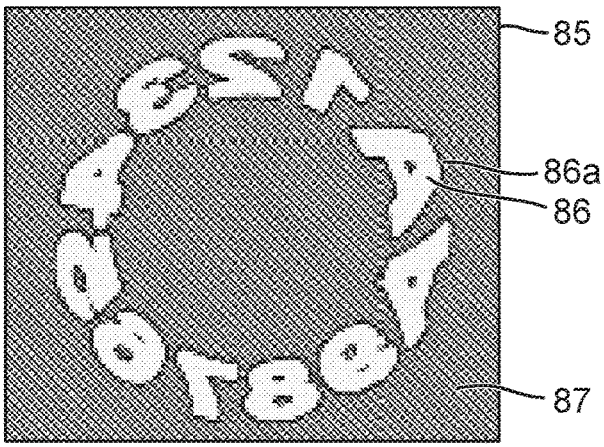
Figure 8C:
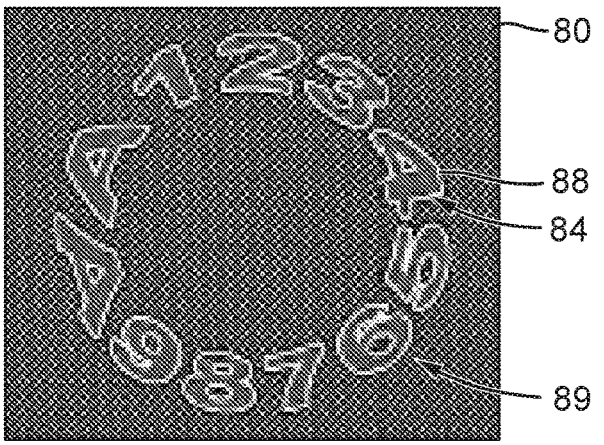

The document 80 of FIG. 8 has a similar structure to the document 10 shown in FIG. 2*e*. As mentioned above, the document 80 comprises a substantially transparent substrate. FIG. 8*a* shows a first print working 81 applied to the first side of the document substrate. FIG. 8*b* shows a second print working 85 applied to the opposing, second side of the substrate. FIG. 8*c* shows the document 80 as seen in transmission.

The first print working 81 of the document comprises a first background print 82 defining the boundaries 83*a* of a plurality of first indicium receiving areas 83. The first indicium receiving areas 83 are spaced laterally from one another such that the lateral regions 83*a* are not joined and do not overlap one another. The first print working 81 further comprises a corresponding plurality of indicia 84 each of which is provided within a respective indicium receiving area 83, such that a single indicium 84 is printed within each indicium receiving area 83. The juxtaposition of the first background print 82 and the indicia 84 generates a corresponding plurality of keylines 88 extending between the boundaries 83*a* of each indicium receiving area 83 and the boundary of the respective indicium 84. This keyline 88 (i.e. the region separating the boundaries 83 of each indicium receiving area 83 and the boundary of the respective indicia 84) is unprinted in the first print working 81.

The second print working 85 of the document shown in FIG. 8 comprises a second background print 87. The second background print 87 defines the boundaries 86*a* of a plurality of second indicium receiving areas 86 which share the same lateral extents as the first indicium receiving areas 83 in the first print working 81. The first and second print workings 81, 85 are applied to opposite sides of the substrate of the document in register such that first and second indicium receiving areas 83, 86 are congruent in the full document 80. In other words the first background print 82 and the second background print 86 each define a plurality of indicium receiving areas 83, 86 with the same lateral extents and positions in the document 80 shown in FIG. 8*c*. Therefore, the keylines 88 are defined between the boundary 86*a* of each second indicium receiving area 86 and the boundary of the respective indicium 84. The indicium receiving areas 86 defined by the second background print 87 are unprinted in the second print working 85.

The first background print 82 and the second background print 87 are at least semi-transparent. Therefore, when viewed in transmission from the first side of the substrate as shown in FIG. 8*a* the document 80 exhibits the indicia 84 surrounded by an unprinted, substantially transparent keyline 88 seen against the superimposed combination of the first background print 82 and the second background print 87. The printed features preferably have contrasting visual appearances and may be easily distinguished from one another and the registration of the features may be easily verified by an observer. The security of the document is further increased if the printed print exhibit different visual appearances. For instance, the first background print 82 may be formed of a semi-transparent green ink, the indicia 84 be formed of an opaque green ink and the second background print 87 may be formed of a semi-transparent blue ink.

Finally, in FIG. 9 there is shown a document 90 in which the identifier 99 is split or separated into two separate parts 94*b*, 94*c* applied to opposing sides of a substantially transparent substrate of the document 90. Each part 94*b*, 94*c* of the identifier includes one or more full indicia 94 and multiple parts of further indicia 94 which are split across the two parts 94*b*, 94*c*. Therefore, the structure of the document 90 of FIG. 9 is similar to that of the document 10 shown in FIG. 2*i*. The parts 94*b* of the identifier 99 (which includes both a whole indicium "/" and the left halves of each "0" indicium) applied to the first side of the substrate preferably have a different appearance to the parts 94*c* of the identifier 99 (which includes the whole indicia "A" and "I" and the right halves of each "0" indicium) applied to the second side of the substrate, as illustrated by the difference in hatching between the two parts 94*b*, 94*c* of the identifier 99.

Figure 9A:
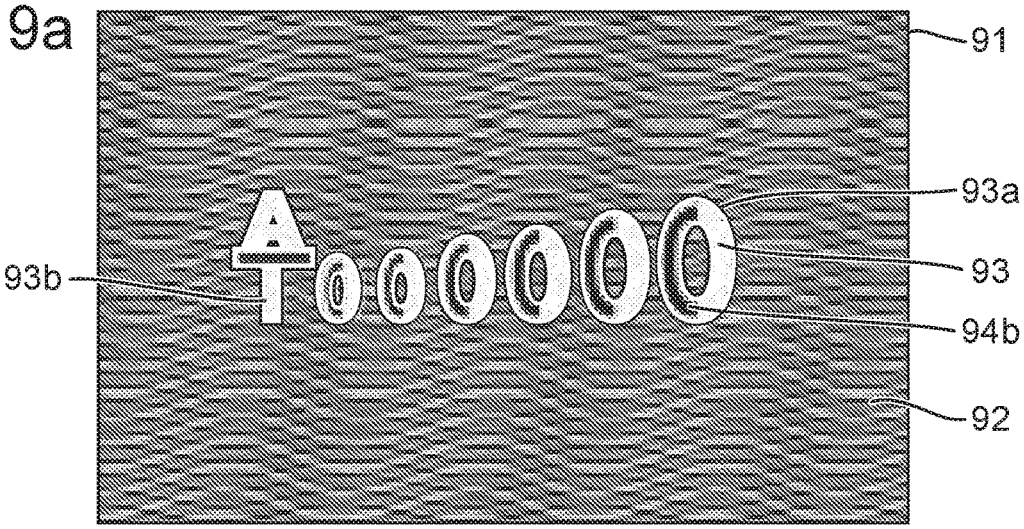
FIG. 9*a* shows a portion of a first print working which may be used to produce a document according to the present invention; a portion of the face of this document as seen in transmission from an angle perpendicular to the plane of the document is shown in FIG. 9*b*; a portion of the face of this document as seen in transmission from an oblique angle to the plane of the document is shown in FIG. 9*c*.

FIG. 9*a* shows a first print working 91 applied to the first side of a document substrate which is substantially transparent. The first print working 91 comprises a background print 92. The background print 92 is an embossed latent line image which exhibits different appearances when viewed at different viewing angles, as will be discussed further below.

The boundaries of the first background print 92 define the boundaries 93*a* of a plurality of indicium receiving areas 93. The first print working 91 further comprises the first part 94*b* of the identifier 99, and includes the full indicium "/" and the left half (portion) of each "0" indicia as viewed from the first side of the substrate. The indicium "/" and the parts of the indicia "0" of the first background print 91 are provided within the indicium receiving areas 93. The indicium receiving areas 93 are otherwise unprinted.

The second print working (not illustrated in an individual drawing) applied to the opposing second side of the document substrate comprises the second part 94*c* of the identifier 99, and includes the full indicium "A" and "I" and the right half of each "0" indicia as viewed from the first side of the substrate.

Figure 9B:
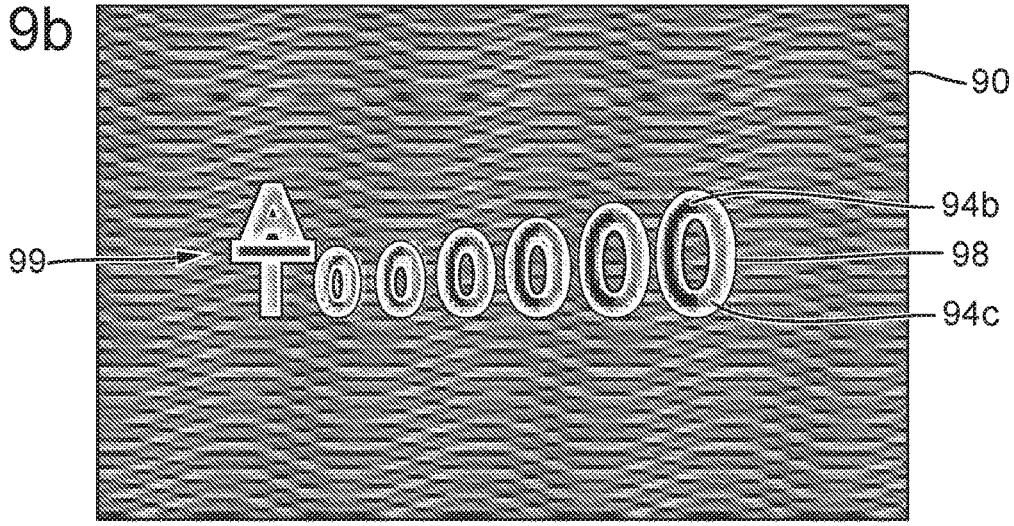

FIG. 9*b* shows the document 90 in transmission from the first side of the document 90 at an angle normal to the plane of the document 90 (such that it corresponds to the view of FIGS. 6*c*, 7*c* and 8*c*). The first print working 91 and second print working are applied to opposite sides of the substrate in register such that the parts 94*b*, 94*c* of the identifier 99 are provided in register (i.e. positioned and aligned laterally) to correctly form the indicia 94 of the identifier 99.

Each of the indicia 94 are positioned laterally within a respective indicium receiving area 93. A keyline 98 formed by the juxtaposition of the indicia 94 and the background print 92 extends around the boundary of each indicium 94, such that the keyline 98 extends between each indicium 94 and the background print 92 from the boundary of the indicia 94 and the boundary 93*a* of the respective indicium receiving area 93. The keyline 98 is unprinted on both the first and second sides of the substrate.

It is noted that the indicium receiving areas 93*b* in which the indicia "A", "/" and "I" are provided are not separated or laterally spaced. Instead, the background print 92 provided to the first side of the document 90 defines a continuous indicium receiving area 93*b* in which all three indicia appear when the document 90 is viewed in transmission. Keylines 98 extending around portions of each of the indicia "A", "/" and "I" are defined between this indicium receiving area 93 and the background print 92. In contrast, each of the "0" indicia are provided in an individual indicium receiving area 92*a*, said areas 92*a* being laterally spaced from one another and the indicium receiving area 92*a* in which "A", "/" and "I" are received or provided.

When the document 90 is viewed in transmission from the first side of the substrate (as shown in FIG. 9*b*) the parts 94*b*, 94*c* of the identifier 99 applied to opposing sides of the substrate are viewed in combination and the identifier 99 is seen as a whole. Furthermore, an unprinted and substantially transparent keyline 98 extends around each indicium 94 of the identifier 99, separating the indicia 94 from the background print 92.

As discussed above, the parts 94*b*, 94*c* of the identifier 99 applied to opposing sides of the document preferably exhibit different appearances (e.g. a different colour, tint, transparency, reflectivity, or pattern). The parts 94*b* of the identifier 99 comprised in the first print working 92 (i.e. the slash "/" and the left-hand halves of the "0" indicia) may appear blue, whereas the parts 94*c* of the identifier 99 comprised in the second print working 95 (i.e. the "A", "I", and the right-hand halves of the "0" indicia) may appear green.

The background print 92 is an embossed latent line image which exhibits an optically variable effect, wherein the appearance of the background print 92 changes as the viewing angle changes. At angles which are substantially perpendicular to the plane of the document (i.e. angles normal to the document) the background print 92 does not exhibit any obvious pattern, as shown in FIG. 9*b*. However, when tilted a latent image is observed.

Figure 9C:
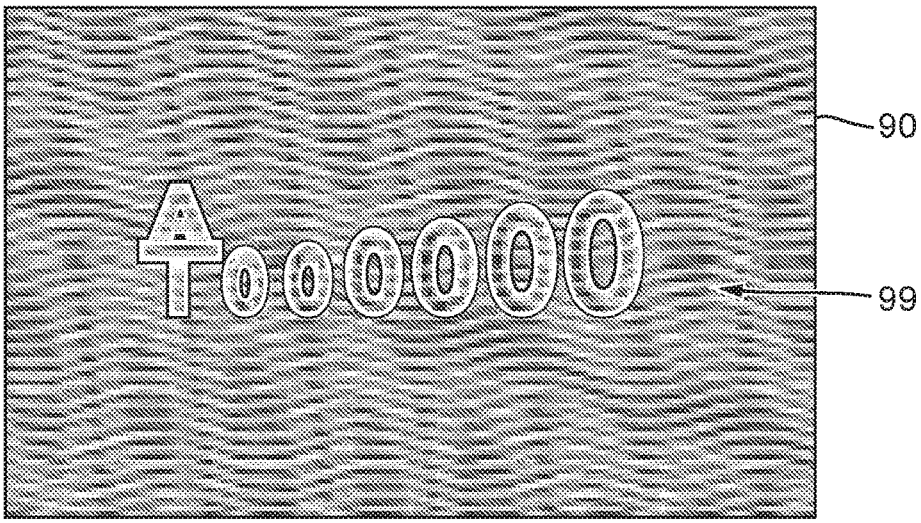

As shown in this example, preferably the embossed latent image formed in the background print 92 is conceptually linked to the identifier 99 applied to the document 90. For instance, as shown in FIG. 9*c*, the embossed latent image may exhibit the numerical portion of the identifier 99: "000000". Therefore, a viewer can compare the latent effect exhibited by the background print 92 to indicia 94 so as to authenticate the document 90. Such embodiments increase the security of the document 90.

In addition, the embossed lines of the latent image of the background print 92 will also provide a distinct tactile effect. Therefore a bearer may be able to distinguish the background print 92 from the unprinted keyline 98 and the printed indicia 94 by both sight and touch. This combination of properties is not easy for a would-be counterfeiter to reproduce using conventional printing technologies for producing large numbers of uniquely identified documents and therefore increases the security of the document 90.

In alternative embodiments of documents according to the present invention one or more of the background print(s) may exhibit alternative optically variable effects. For instance, the first and/or second background print may comprise a lenticular device, diffractive structure (e.g. a hologram or kinegram), moiré magnifier, an optically variable pigment or ink, or an alternative optically variable device. These documents offer increased security.

In each of the specific embodiments discussed above the documents comprise the same structure or cross section at each indicium. Therefore, each of the indicia in an identifier exhibits keylines with similar appearances. However, this is not essential, and alternatively the appearance of a keyline and extent that each keyline extends around its respective indicium may be varied within a document.

For instance a document (and series of such documents) may be provided with an identifier formed of a plurality of indicia, wherein: one or more of the indicia are provided without any keyline; one or more of the indicia which are partially or wholly surrounded by an unprinted keyline; and/or one or more of the indicia which are partially or wholly surrounded by a printed keyline. In addition a single indicium may be provided with multiple keylines which extend round different portions of the indicium and exhibit different properties (e.g. such that the different keylines visually contrast). These variations further complicate reproduction of documents in the series and increase the security of the series.

Figure 10A:
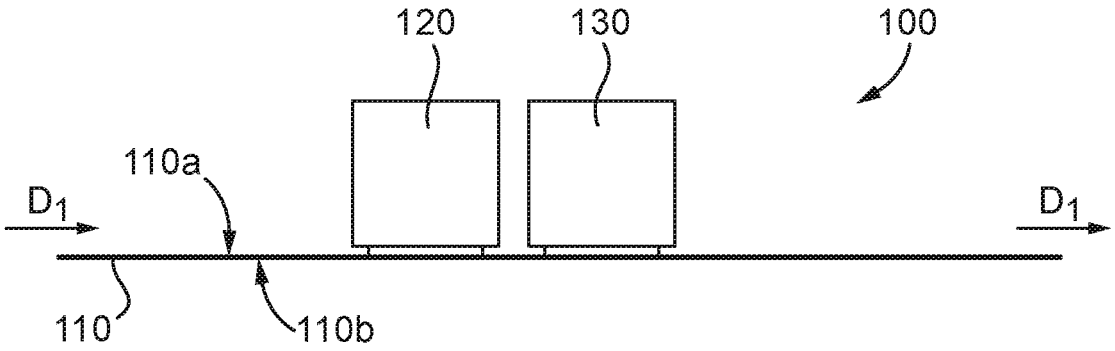
FIGS. 10*a* and 10*b* illustrate schematically web-fed printing systems for manufacturing the documents discussed above.
Figure 10B:
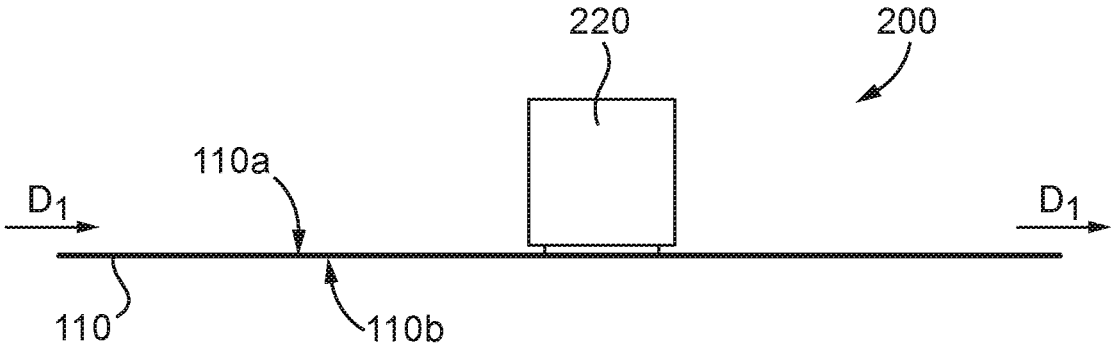
Figure 11A:
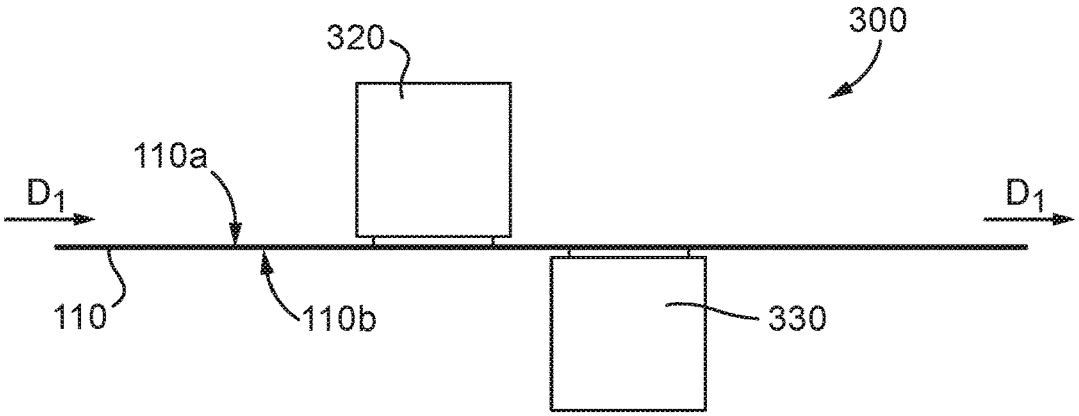
FIGS. 11*a*, 11*b* and 11*c* illustrate schematically further web-fed printing systems for manufacturing the documents discussed above.
Figure 11B:
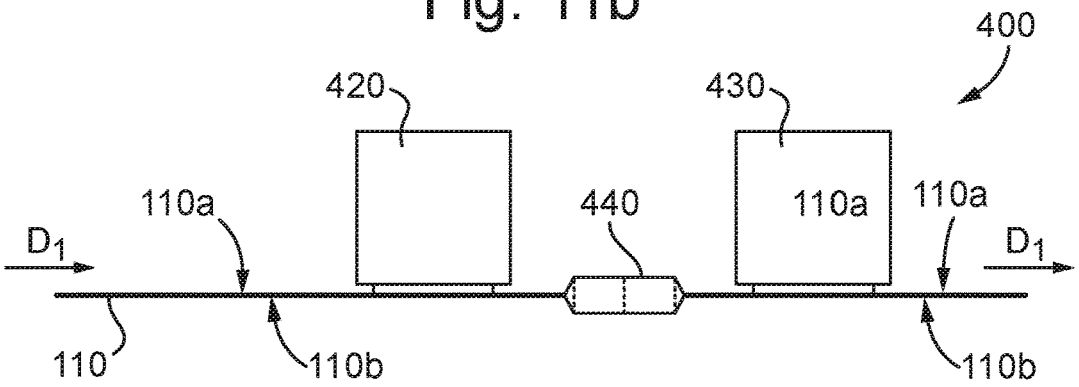
Figure 11C:
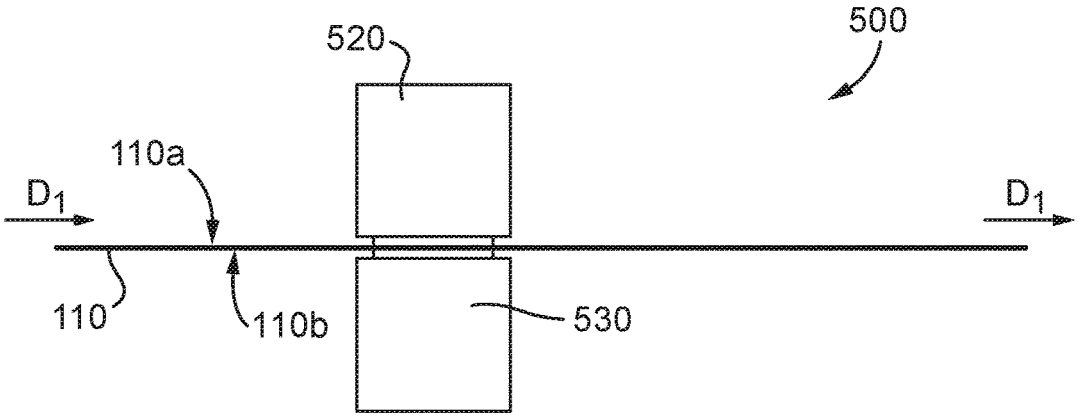

FIGS. 10 and 11 illustrate schematically web-fed printing systems for manufacturing the documents discussed above. In each case a substrate 110 with opposed first and second sides 110*a*, 110*b* travels in direction $D_1$ through one or more printing stations. In each case, if the substrate 110 is not self-supporting a carrier layer (not shown) may be used. The printing stations are preferably digital printing systems (e.g. inkjet printing, laser printing, dye sublimation, or xerography systems). However, this is not essential.

FIGS. 10(*a*) and 10(*b*) illustrate schematically two system layouts 100, 200 for manufacturing a document where print workings are applied to a first side 110*a* of a substrate 110 (i.e. the document is printed "single sided").

FIG. 10(*a*) shows a printing technique and system 100 where one or more print workings are applied to a first side 100*a* of a document substrate 110. A continuous horizontal web of substrate 110 moves in direction $D_1$. The substrate has two opposing sides 110*a*, 110*b*. As shown, the first side 110*a* is the upper surface 110*a* of the web, whilst the second side 110*b* is the lower surface of the web.

Two print stations 120, 130 are located in contact with or adjacent to the first side 110*a* of the substrate web. At each print station 120, 130 one or more print workings or layers are applied to the upper surface 110*a* of the substrate 110. The print stations 120, 130 apply print workings to the first side 110*a* of the substrate 110 in sequence.

For instance, when manufacturing a document 10 as shown in FIG. 2*a* or a document 30 as shown in FIG. 4*a*, the first print station in direction $D_1$ may apply a first print working comprising the background print 12, 32 and the second print station in direction $D_1$ may apply a second print working comprising an identifier formed of a plurality of indicia 14, 34. Where the document 10, 30 comprises a printed keyline region 20, 40 as shown in FIGS. 2*b*, 2*c*, 4*b*, 4*c* and 4*d* the indicium receiving print 20, 40 may be provided by the first print station 120 as part of the first print working or by the second print station 130 as part of the second print working. Alternatively, the indicium receiving print 20, 40 may be applied as a separate print working by either the first or second print stations 120, 130, or by an alternative print station not shown in FIG. 10*a*.

Alternatively, the printed features discussed above may be applied simultaneously to the first side 110*a* of the substrate 110 in a single print working using a single print station 120 as in the system 200 shown in FIG. 10(*b*).

The simultaneous printing system 200 illustrated using FIG. 10(*b*) may be more accurate than the system 100 shown in FIG. 10(*a*). This is because it may be difficult to accurately locate or align the different print stations 120, 130 of FIG. 10(*a*) relative to each other. Consequently, it may be difficult to achieve an accurate, or close, registration between the print workings and layers applied to the opposing sides of the substrate.

FIGS. 11(*a*), 11(*b*) and 11(*b*) illustrate schematically three system layouts 300, 400, 500 for manufacturing a document where print workings are applied to each side 110*a*, 110*b* of a substrate 110 (i.e. the document is printed "double sided").

The system 300 shown in FIG. 11(*a*) comprises two print stations 320, 330. As will be seen, the first print station 320 is provided above the web of substrate 110 (i.e. on a first side of the web), whereas the second print station 330 is provided below the web (i.e. on a second side of the web). These print stations 320, 330 may apply print workings to the opposing sides 110*a*, 110*b* of the substrate 110. The two print stations 320, 330 are offset from one another in the direction of travel $D_1$ of the web.

For instance, the first print station 320 may apply a first print working comprising (for instance) a first background print and the second print station 330 may apply a second print working comprising (for instance) a second background print and an identifier, or vice versa. These print workings will be applied sequentially since the print stations 320, 330 are offset from one another in the direction of travel $D_1$ of the web.

FIG. 11(*b*) shows an alternative system 400 for printing on both sides of a web of substrate 110. Two print stations 420, 430 are provided sequentially (i.e. offset in the direction of travel $D_1$) on the same side of the web. As shown in FIG. 11(*b*) the print stations 420, 430 are both above the web.

Between the two print stations 420, 430 the web of substrate 110 is flipped or turned at section 440, such that it is rotated by 180° about the direction of travel $D_1$. Therefore, the first print station 420 may apply one or more print workings to the first side 110*a* of the substrate 110 and subsequently the second print station may apply one or more print workings to the second side 110*b* of the substrate 110. Such a system is more compact as printing stations only need to be provided to one side of the web (e.g. the upper side as shown in FIG. 11*b*).

Finally, FIG. 11(*c*) shows a further system 500 for printing on either side 110*a*, 110*b* of a substrate 110 simultaneously. Two print stations 520, 530 are provided on opposing sides of the web so that they may apply one or more print workings to either side 110*a*, 110*b* of the substrate 100 simultaneously. The two print stations 520, 530 may be part of a single printer or printing system.

In practice any of the systems 100 to 500 discussed above may be provided with further upstream or downstream print stations adapted to provide further print workings or layers (e.g. opacifying layers, protective layers, anti-static layers) to the substrate 110 simultaneously, or in preceding or subsequent steps.

In the examples discussed above, all of the steps described are web-based processes, i.e. layers and print workings are applied to a web of the substrate 110, e.g. in one in-line web-fed process. Typically a web with a large width (e.g. between 0.75 and 1.5 m) is supplied for this purpose.

However, in alternative embodiments of the present invention, documents are produced using a combination of web fed and sheet fed process steps. For instance, for some process steps it is desirable to reduce the width of the web, e.g. so that shorter (and hence less costly) processing tools can be used. It is also desirable to carry out certain process steps on individual sheets of the material, rather than on a continuous web.

In some embodiments, at least a first print working is applied using web based processes. These print workings and opacifying layers are applied on one side of a polymer substrate web with a large width (e.g. between 0.75 and 1.5 m). The web is then divided into sheets for sheet fed printing whereby at least a second print working is applied in contact with or above a side of the substrate.

Converting a web substrate to a sheet substrate (i.e. dividing the web into sheets) may involve slitting the initial web along its longitudinal direction so as to reduce its width, subsequent processing steps utilising processing tools of correspondingly shorter width compared with those of the preceding steps. The slit webs are then converted in sheets by cutting it along its cross direction at intervals spaced in the longitudinal direction. This process is sometimes referred to as "sheeting". Each sheet will preferably be sized so as carry a plurality of the final documents. Subsequent printing processes and the application of further print workings may then be performed using sheet-fed machinery. The resulting sheets may be divided further before or after printing in order to produce the final documents as required. In other words, documents according to the present invention may be printed using a combination of web-feed and sheet-fed printing steps.

Alternatively, documents according to the present invention may be solely constructed using sheet-fed processes. In such processes, all print workings and/or layers are applied to a stationary sheet of substrate. This sheet of substrate may be rotated or flipped to apply print workings or layers to its reverse.

The invention claimed is:

1. A method of manufacturing a document of a series of documents which are identical in content except for a respective identifier which uniquely identifies each document within the series, each identifier comprising at least a first indicium, the or each indicium defining a boundary;

the method comprising the steps of:

providing a substrate;

applying a first background print on the substrate, the first background print defining at least part of the boundary of an indicium receiving area;

applying the respective identifier on the substrate, such that the first indicium is provided in the indicium receiving area;

the first background print and the respective identifier being applied such that when the document is viewed in at least one of transmission and reflection the juxtaposition of the first background print and the first indicium is such that a keyline extending around at least a portion of the boundary of the first indicium is defined between the first indicium and the boundary of the indicium receiving area; wherein the document is transparent or semi-transparent across part of, or the whole of, the indicium receiving area, and the first indicium is visible in its entirety from each side of the substrate when the document is viewed in transmission and reflection.

2. A method according claim 1, further comprising applying a second background print on the substrate, wherein the first background print and the second background print are applied to opposing sides of the substrate, wherein the second background print defines said at least part of the boundary of the indicium receiving area.

3. A method according to claim 1, wherein the substrate is at least semi-transparent and wherein a portion of the second background print may be observed in transmission through the keyline from the first side of the substrate.

4. A method according to claim 1, wherein either: the first background print and the identifier are applied on the same side of the substrate;

the first background print and the identifier are applied on opposing sides of the substrate; or, a first part of the respective identifier is applied on a first side of the substrate, and a second part of the respective identifier is applied on the second side of the substrate wherein the first part of the respective identifier comprises a first part of the first indicium, and the second part of the identifier comprises a second part of the first indicium and wherein the respective identifier comprises two or more indicia, and wherein the first part of the identifier and/or the second part of the identifier comprises at least one indicium of said two or more indicia.

5. A method according to claim 1, wherein the first and/or second background print extends over a lateral area which is greater than or equal to twice the lateral area over which the first indicium extends, and/or, wherein the first and/or second background print extends over at least 10% of the lateral area of the document.

6. A method according to claim 1, wherein the keyline is visible from each side of the substrate when the document is viewed in transmission and/or reflection.

7. A method according to claim 1, wherein the keyline extends around at least 15% of the boundary of the first indicium by length.

8. A method according to claim 1, wherein the keyline visually contrasts with the first indicium and the first and/or second background print, wherein the keyline exhibits a different tint, transparency, reflectivity, or pattern than the first indicium, the first background print and/or the second background print.

9. A method according to claim 1, wherein the keyline is an unprinted region.

10. A method according to claim 1, further comprising applying a print in the indicium receiving area, wherein the print in the indicium receiving area is an indicium receiving print, and/or wherein the method further comprises applying microtext or a security pattern in the indicium receiving area.

11. A method according to claim 1, wherein the respective identifier is an alphanumeric code and/or a serial code.

12. A method according to claim 1, wherein the keyline has a width of at least 25 μm and/or wherein the keyline has a width of at most 2 mm.

13. A method according to claim 1, wherein the first background print and the identifier are applied in the same print working.

14. A method according to claim 1, wherein each identifier comprises a plurality of indicia, each indicium defining a boundary;

wherein the first background print defines at least part of the boundary of a plurality of indicium receiving areas;

wherein the respective identifier is applied such that each indicium is provided in an indicium receiving area of said plurality of indicium receiving areas;

the first background print and the respective identifier being applied such that when the document is viewed in at least one of transmission and reflection the juxtaposition of the first background print and each indicium is such that a keyline extending around at least a portion of the boundary of each indicium is defined between each indicium and the indicium receiving area in which it is provided.

15. A method according to claim 1, wherein the document is a security document.

16. A method of manufacturing a series of documents which are identical in content except for a respective identifier which uniquely identifies each document within the series, each identifier comprising at least a first indicium, the or each indicium defining a boundary;

the method of manufacturing each document comprising the steps of:

providing a substrate;

applying a first background print on the substrate, the first background print defining at least part of the boundary of an indicium receiving area;

applying the respective identifier on the substrate, such that the first indicium is provided in the indicium receiving area;

the first background print and the respective identifier being provided such that when the document is viewed in at least one of transmission and reflection the juxtaposition of the first background print and the first indicium is such that a keyline extending around at least a portion of the boundary of the first indicium is defined between the first indicium and the boundary of the indicium receiving area; wherein the document is transparent or semi-transparent across part of, or the whole of, the indicium receiving area, and the first indicium is visible in its entirety from each side of the substrate when the document is viewed in transmission and reflection.

17. A document of a series of documents which are identical in content except for a respective identifier which uniquely identifies each document within the series, each identifier comprising at least a first indicium, the or each indicium defining a boundary;

the document comprising:

a substrate;

a first background print provided on the substrate, the first background print defining at least part of the boundary of an indicium receiving area;

the respective identifier provided on the substrate, such that the first indicium is provided in the indicium receiving area;

the first background print and the respective identifier being provided such that when the document is viewed in at least one of transmission and reflection the juxtaposition of the first background print and the first indicium is such that a keyline extending around at least a portion of the boundary of the first indicium is defined between the first indicium and the boundary of the indicium receiving area; wherein the document is transparent or semi-transparent across part of, or the whole of, the indicium receiving area, and the first indicium is visible in its entirety from each side of the substrate when the document is viewed in both transmission and reflection.

18. A series of documents which are identical in content except for a respective identifier which uniquely identifies each document within the series, each identifier comprising at least a first indicium, the or each indicium defining a boundary; each document comprising:

a substrate;

a first background print provided on the substrate, the first background print defining at least part of the boundary of an indicium receiving area;

the respective identifier provided on the substrate, such that the first indicium is provided in the indicium receiving area;

the first background print and the respective identifier being provided such that when the document is viewed in at least one of transmission and reflection the juxtaposition of the first background print and the first indicium is such that a keyline extending around at least a portion of the boundary of the first indicium is defined between the first indicium and the boundary of the indicium receiving area; wherein the substrate is transparent or semi-transparent across part of, or the whole of, the indicium receiving area, and the first indicium is visible in its entirety from each side of the substrate when the document is viewed in transmission and reflection.

* * * * *